US007530251B2

(12) United States Patent
Takada et al.

(10) Patent No.: US 7,530,251 B2
(45) Date of Patent: May 12, 2009

(54) ANNULAR COMPONENT FABRICATING METHOD, DIE FOR USE IN SUCH FABRICATING METHOD AND ANNULAR COMPONENT FABRICATED THEREBY

(75) Inventors: Masahiro Takada, Okazaki (JP); Yasuhiro Hideshima, Anjo (JP)

(73) Assignee: Denso Corporation, Kariya (JP)

( * ) Notice: Subject to any disclaimer, the term of this patent is extended or adjusted under 35 U.S.C. 154(b) by 283 days.

(21) Appl. No.: 11/525,937

(22) Filed: Sep. 25, 2006

(65) Prior Publication Data

US 2007/0074557 A1 Apr. 5, 2007

(30) Foreign Application Priority Data

Oct. 5, 2005 (JP) ..... 2005-292627
Jul. 19, 2006 (JP) ..... 2006-197249

(51) Int. Cl.
*B21D 22/00* (2006.01)

(52) U.S. Cl. ..... 72/356; 72/353.2; 72/354.8

(58) Field of Classification Search ..... 72/352, 72/353.2, 354.6, 354.8, 356, 358, 357, 360, 72/370.12, 370.13
See application file for complete search history.

(56) References Cited

U.S. PATENT DOCUMENTS 2,789,344 A * 4/1957 Kaul ..... 72/256
3,365,926 A * 1/1968 Price ..... 72/283
4,397,345 A * 8/1983 Ramaratnam et al. ..... 152/406
4,478,066 A * 10/1984 Olschewski et al. ..... 72/358
4,516,421 A * 5/1985 Tavin ..... 72/354.8
5,446,962 A * 9/1995 Matossian et al. ..... 29/894.324
6,018,977 A * 2/2000 Kanno et al. ..... 72/355.4
6,053,023 A * 4/2000 Landrum ..... 72/355.4
7,047,787 B2 * 5/2006 Kanemitsu et al. ..... 72/355.4
7,171,838 B2 * 2/2007 Shiokawa ..... 72/356

FOREIGN PATENT DOCUMENTS

JP A 63-186964 8/1988

* cited by examiner

*Primary Examiner*—Edward Tolan
(74) *Attorney, Agent, or Firm*—Oliff & Berridge, PLC

(57) ABSTRACT

A method of fabricating an annular component part is disclosed wherein press forming is carried out to prepare an annular body having a cylindrical wall, having a root portion and a distal end, and an annular flange portion. The fabricating method comprises expanding an inner circumferential periphery of the cylindrical wall to an inner diameter corresponding to an inner diametric concave portion formed on the inner circumferential periphery and squeezing the cylindrical wall in a tapered profile such that the inner diameter of the cylindrical wall gradually decreases. During inner diametric expanding operation, an annular shoulder is formed on the inner circumferential periphery of the cylindrical wall and plays a role as an undercut of the annular component.

11 Claims, 11 Drawing Sheets

ANNULAR COMPONENT FABRICATING METHOD, DIE FOR USE IN SUCH FABRICATING METHOD AND ANNULAR COMPONENT FABRICATED THEREBY

CROSS REFERENCE TO RELATED APPLICATIONS

This application is related to Japanese Patent Application No. 2005-292627 and No. 2006-197249, filed on Oct. 5, 2005 and Jul. 19, 2006, respectively, the contents of which are hereby incorporated by reference.

BACKGROUND OF THE INVENTION

1. Technical Field of the Invention

The present invention relates to fabricating methods for annular component parts and, more particularly, to a method of fabricating an annular component part, playing a role as a stop collar available to be mounted on an output shaft of a starter for startup of an engine, a die for use in such a fabricating method and an annular component part fabricated by such a fabricating method.

2. Description of the Related Art

In the related art practice, as shown in FIG. 14, a starter has an output shaft 100 slidably carrying thereon a pinion 110 that is moved into meshing engagement with a ring gear (not shown) of an engine. With such a starter, attempt has heretofore been made to mount a stop collar 120 on the output shaft 100 by means of a snap ring 130 with a view to restricting a shift position of the pinion 110 as disclosed in Japanese Patent examined Publication No. 6-78746.

The stop collar 120 has been fabricated by a method in the related art practice, which will be described below with reference to FIG. 15.

The fabricating method comprises:

(1) Cutting and Forging: Bar steel is cut into process raw material in a given length and then subjected to forging to form a steel bar member 200 as shown in FIG. 1.

(2) Softening and Annealing: The forging formation results in hardening of the steel bar member 200, which is annealed and softened.

(3) Barrel Grinding: Barrel grinding is conducted to remove oxidized scale from a surface of the steel bar member 200.

(4) Lubricating Film Treatment: Bonderizing treatment is conducted to form a phosphoric acid film on the surface of the steel bar member 200.

(5) Cold Forging (Molding) Step: Cold forging extrusion forming is carried out on the steel bar member 200 to form a workpiece 202 with a cylindrical wall 202*a* and a bottom wall 202*b* having a downward protrusion 202*c* as shown in FIG. 15B.

(6) Cold Forging (Punching) Step: Punching is carried out to form a bore 202*d* on the bottom wall 202*b* of the workpiece to form a workpiece 202A formed with an annular flange 202*e* at a lower end of the cylindrical wall 202*a* as shown in FIG. 15C.

(7) Cutting (Undercut): An inner circumferential periphery 202*f* of the workpiece 202A is formed with an annular concave portion 202*g* in the form of an annular recess by cutting to provide a workpiece 202B as shown in FIG. 15D.

With such a fabricating method set forth above, since the workpiece is formed by cold forging work that results in an increase in deformation of a whole of the raw material, a need arises for conducting specific processes including softening and annealing, barrel grinding (for removing scale) and lubricating film treatment. Moreover, since cold forging work is hard to form a depression in an undercut shape, a separate cutting machine needs to be used for the cutting operation. As a result of these consequences, the related art practice encounters various issues with an increase in processing time and a need for preparation of processing equipment only for such cutting. Another issue includes an increase in inventory holding cost and requisite space or surface area on an intermediate production process. Additionally, a drop occurs in productivity in spite of the product's simple structure and it's difficult to shorten the delivery schedule. Moreover, due to large energy consumption, the softening and annealing step and the lubricating film treatment go against the trend of modem energy saving solution.

SUMMARY OF THE INVENTION

The present invention has been completed with a view to addressing the above issue and has an object to provide a method of fabricating an annular component part, which can achieve a reduction in work time and a reduction in equipment cost and requisite space to provide improved productivity while contributing to energy saving, a die for use in such a fabricating method and an annular component part fabricated by such a method.

To achieve the above object, one aspect of the present invention provides a method of fabricating an annular component part composed of an annular body formed from a plate-like metallic raw material by press forming and having a cylindrical wall, formed with a root portion and a distal end, which has an inner circumferential periphery formed with an inner diametric concave portion playing a role as an undercut. The method comprising expanding the inner circumferential periphery of the cylindrical wall to an inner diameter corresponding to the inner diametric concave portion upon forcing a punch into the inner circumferential periphery of the cylindrical wall, and squeezing the cylindrical wall in a tapered profile such that the inner diameter of the cylindrical wall gradually decreases from the root portion to the distal end of the cylindrical wall.

With the fabricating method set forth above, expanding the inner peripheral circumference of the cylindrical wall to an inner diameter corresponding to the inner diametric concave portion of the annular body and subsequently squeezing the cylindrical wall of the annular body in a tapered shape allows the inner circumferential periphery of the cylindrical wall to be formed with the inner diametric concave portion that plays a role as the undercut of the annular component part. Thus, no need arises for forming the inner diametrical concave portion on the inner circumferential periphery of the cylindrical wall of the annular body by cutting operation. Further, a series of operations can be performed merely upon press forming to fabricate the annular component part using the plate-like raw material. Therefore the method of fabricating the annular component part according to the present invention can be carried out without a need for executing cold forging operation as required in the related art practice. This results in no need for executing special operations such as softening and annealing, barrel grinding (for removing oxide scale) and lubrication oil treatment. This enables work time to be shortened while achieving a reduction in equipment cost and associated surface area, with the resultant improvement in productivity. Also, since no need arises for executing softening and annealing and lubrication oil treatment that result in increased energy consumption, energy saving can be achieved.

With the method of fabricating the annular component part, the squeezing the cylindrical wall may comprise preprocessing for preliminarily forming an annular stepped portion on the inner circumferential periphery of the cylindrical wall in a striation as a deformation starting point when squeezing the cylindrical wall, and wherein the preprocessing is executed concurrently with the expanding the inner circumferential periphery of the cylindrical wall or in a phase between the expanding the inner circumferential periphery of the cylindrical wall and the squeezing the cylindrical wall.

With the fabricating method mentioned above, by preliminarily forming the annular stepped portion on the inner circumferential periphery of the cylindrical wall in the striation as the deformation starting point before squeezing the cylindrical wall, the cylindrical wall of the annular body can be formed in the tapered form precisely during the squeezing operation without causing deformation (such as for instance the R-shape thereof) on a profile of the inner diametric concave portion of the inner circumferential periphery of the cylindrical wall.

With the present embodiment mentioned above, the method of fabricating the annular component part may further comprise conducting inner diametric chamfering operation upon compressing an inner diametric corner of the distal end of the cylindrical wall to form a chamfer thereon prior to the squeezing the cylindrical wall.

During the squeezing operation, compressive stress concentrates on an inner peripheral corner area of the distal end of the cylindrical portion, thereby causing concentrated compressive strain to cause compressive wrinkling in a cracking shape. The occurrence of compressive wrinkling results in deterioration in product strength and a remarkable drop in product quality.

On the contrary, by preliminarily forming the chamfer on the inner peripheral corner of the cylindrical wall of the annular body, the squeezing operation can be smoothly carried out to squeeze the cylindrical wall of the annular body in the tapered form without causing an increase in stress concentration on the inner peripheral corner of the cylindrical portion, whereby compressive wrinkling in the cracking shape can be prevented. Also, the chamfer formed on the inner peripheral corner of the cylindrical wall may be formed in either a C-chamfer or an R-chamfer.

With the method of fabricating the annular component part, the inner diametric chamfering operation is executed before the expanding the inner circumferential periphery of the cylindrical wall is executed.

In this case, the expanding the inner circumferential periphery of the cylindrical wall can be executed under a condition where the inner peripheral corner portion of the cylindrical wall is formed with a chamfer portion, the chamfer portion formed at the inner peripheral corner of the cylindrical wall can be used as a guide surface to guide the punch of the press forming machine during the operation to expand the inner circumferential periphery of the cylindrical wall. That is, no punch interferes with the inner peripheral corner of the cylindrical wall at the distal end thereof and the punch can be smoothly forced into the inner circumferential periphery of the cylindrical wall. Thus, the inner diametric expanding operation can be performed in a smooth fashion.

The method of fabricating the annular component part may further comprise conducting preliminarily chamfering operation prior to the expanding the inner circumferential periphery of the cylindrical wall to form a chamfering annular concave portion on an end face of the annular body in an entire circumference thereof at a position in opposition to the cylindrical wall so as to allow a final configuration to have an outer peripheral corner portion formed with a chamfer, and conducting outer diametric blanking operation after the squeezing the cylindrical wall to blank the annular body at the chamfering annular concave portion thereof in an outer diameter of a final shape.

By forming the chamfering annular concave portion on the end face of the annular body in the entire circumference thereof at the position in opposition to the cylindrical wall upon which the squeezing operation is carried out, the annular body is blanked at the chamfering annular concave portion in the outer diameter of the final shape, thereby enabling the annular body to have an outer peripheral corner formed with a chamfer. Also, due to the execution of the preliminarily chamfering operation prior to the expanding the inner circumferential periphery of the cylindrical wall, the inner diametric concave portion can be formed on the inner circumferential periphery of the cylindrical wall in a highly precise fashion by executing the inner diametric expanding operation and the squeezing operation without causing the occurrence of deformation the inner diametric concave portion.

In addition, restricting the chamfering annular concave portion with the lower die during the inner diametric expanding operation enables plastic flow of material to be controlled. This is effective for preventing the occurrence of a shear drop or deformation of the cylindrical wall of the workpiece.

With the method of fabricating the annular component part, the squeezing the cylindrical wall is executed upon using a tapered punch held in abutting engagement with an outer circumferential periphery of the cylindrical wall of the annular body.

With such a method, the inner circumferential periphery of the cylindrical wall is expanded to an inner diameter corresponding to that of the inner diametric concave portion of the annular body and, subsequently, the cylindrical wall is squeezed in a tapered shape using the tapered punch. With such a process, since the inner circumferential periphery of the annular body can be formed with the inner diametric concave portion playing a role as an undercut, no cutting process is required to form the inner diametric concave portion on the inner circumferential periphery of the cylindrical wall. Also, since a series of operations from the plate-like raw material to the squeezing operation can be accomplished merely with press forming operations. Accordingly, the annular component part can be fabricated with no need for cold forging step as required in the related art practice. Therefore, no need arises for carrying out specific operations such as, for instance, softening and annealing, barrel grinding (for removal of oxide scale) and lubrication film treatment or the like. This enables work time to be shortened while achieving a reduction in equipment cost and an associated occupied space, providing an increase in productivity. Moreover, since no need arises for carrying out the softening and annealing operation and lubrication film treatment that consume large energy, contributing to saving of energy in an efficient manner.

With the method of fabricating the annular component part, the squeezing the cylindrical wall may be executed upon using a roller held in abutting engagement with an outer circumferential periphery of the cylindrical wall of the annular body.

With the fabricating method of the present embodiment, the inner circumferential periphery of the cylindrical wall is expanded to an inner diameter corresponding to that of the inner diametric concave portion of the annular body and, subsequently, the cylindrical wall is squeezed in a tapered shape using the roller. With such a process, since a series of operations from the plate-like raw material to the squeezing operation can be accomplished with press forming operations and roller operation. Accordingly, the annular component part can be fabricated with no need for cold forging step as required in the related art practice. Therefore, specific operations such as, for instance, softening and annealing, barrel grinding (for removal of oxide scale) and lubrication film treatment or the like can be omitted, resulting in an increase in productivity. Moreover, since no need arises for carrying out the softening and annealing operation and lubrication film treatment that consume large energy, contributing to saving of energy in an efficient manner.

With the fabricating method according to the present invention, an annular component part can be fabricated with the resultant shortening of work time and reduction in equipment cost and associated space (surface area). This results in a reduction in productivity and the stop collar, which has the inner diametric concave portion playing a role as an undercut, can be fabricated at low cost. This stop collar can be employed as a movement restricting means to restrict the excessive movement of a pinion carried on an output shaft of a starter.

Another aspect of the present invention provides a method of fabricating an annular component part composed of an annular body formed from a plate-like metallic raw material by press forming and having a cylindrical wall, formed with a root portion and a distal end, which has an inner circumferential periphery formed with an inner diametric concave portion playing a role as an undercut. The method comprises:

a) conducting a first outer diametric blanking operation to form the metallic raw material into a circular component by blanking;

b) conducting a base bore punching operation to form a base bore in the circular component at a radially central area thereof;

c) conducting a base bore expanding operation to form the annular body upon expanding the base bore of the circular component so as to allow the cylindrical wall to be formed on the circular component on one side thereof while forming an annular flange portion radially extending from the root portion of the cylindrical wall;

d) conducting a preliminarily chamfering operation to preliminarily form a chamfering annular concave portion on the annular flange portion at an end face thereof in opposition to the cylindrical wall so as to allow the annular body to be formed in a final configuration with an outer peripheral corner portion formed with a chamfer;

e) conducting an inner diametric chamfering operation to compress an inner diametric corner area of the distal end of the cylindrical wall to from a chamfer thereon;

f) conducting an inner diametric expanding operation upon forcing a punch into the inner circumferential periphery of the cylindrical wall and expanding the same to an inner diameter corresponding to that of the inner diametric concave portion;

g) conducting a squeezing operation to squeeze the cylindrical wall in a tapered profile such that the cylindrical wall has an inner diameter that gradually decreases from the root portion to the distal end; and h) conducting a second outer diametric blanking operation to blank the circular component along with the chamfering annular concave portion into the final configuration.

With the fabricating method set forth above, the inner circumferential periphery of the cylindrical wall is expanded to an inner diameter corresponding to the inner diametric concave portion of the annular body and, thereafter, the cylindrical wall of the annular body is squeezed in a tapered shape. This allows the inner circumferential periphery of the cylindrical wall to be formed with the inner diametric concave portion that plays a role as the undercut of the annular component part. Thus, no need arises for forming the inner diametrical concave portion on the inner circumferential periphery of the cylindrical wall of the annular body by cutting operation. Further, a series of operations starting from the first outer diametric blanking operation to the second outer diametric blanking operation can be performed merely upon press forming to fabricate the annular component part. Therefore, no need arises for executing cold forging operation as required in the related art practice. This results in no need for executing special operations such as softening and annealing, barrel grinding (for removing oxide scale) and lubrication oil treatment. This enables work time to be shortened while achieving a reduction in equipment cost and associated surface area, with the resultant improvement in productivity. Also, since no need arises for executing softening and annealing and lubrication oil treatment that result in increased energy consumption, energy saving can be achieved.

Further, due to the inner peripheral corner area of the cylindrical wall at the distal end thereof being compressed and formed with a chamfer, the cylindrical wall of the annular body can be squeezed in the tapered profile during the squeezing operation while enabling a reduction in stress concentration acting on the inner peripheral corner area of the distal end of the cylindrical wall and precluding the occurrence of compressive wrinkling in a cracking shape.

Further, the inner circumferential periphery of the cylindrical wall can be expanded under a condition where the inner peripheral corner of the distal end of the cylindrical wall is formed with the chamfer. Therefore, the chamfer formed on the distal end of the cylindrical wall at the inner peripheral corner can be used as a guide to allow a punch of a press forming machine to be smoothly forced into the inner circumferential periphery of the cylindrical wall. That is, no punch interferes with the inner peripheral corner of the distal end of the cylindrical wall, thereby enabling the punch to be forced into the inner circumferential periphery of the cylindrical wall. Thus, the inner diametric expanding operation can be smoothly performed.

With the method of fabricating the annular component part, the conducting the squeezing operation may comprise preprocessing for preliminarily forming an annular stepped portion on the inner circumferential periphery of the cylindrical wall in a striation as a deformation starting point when conducting the squeezing operation, and wherein the preprocessing is executed concurrently with the inner diametric expanding operation or in a phase between inner diametric expanding operation and the squeezing operation.

Preprocessing for preliminarily forming an annular stepped portion on the inner circumferential periphery of the cylindrical wall in the striation as the deformation starting point allows the squeezing operation to be smoothly performed and the inner body to be formed with the inner diametric concave portion in a high precision without causing the occurrence of deformation thereof.

With the method of fabricating the annular component part, the squeezing operation is executed upon using a tapered punch held in abutting engagement with an outer circumferential periphery of the cylindrical wall of the annular body.

With such a fabricating method, the inner circumferential periphery of the cylindrical wall is expanded to an inner diameter corresponding to the inner diametric concave portion of the annular body and, thereafter, the cylindrical wall of the annular body is squeezed in a tapered shape using the tapered punch. Thus, no need arises for forming the inner diametrical concave portion on the inner circumferential periphery of the cylindrical wall of the annular body by cutting operation. Further, a series of operations starting from the first outer diametric blanking operation to the second outer diametric blanking operation can be performed merely upon press forming to fabricate the annular component part. Therefore, no need arises for executing cold forging operations as required in the related art practice. This results in no need for executing special operations such as softening and annealing, barrel grinding (for removing oxide scale) and lubrication oil treatment. This enables work time to be shortened while achieving a reduction in equipment cost and associated surface area, with the resultant improvement in productivity. Also, since no need arises for executing softening and annealing and lubrication oil treatment that result in increased energy consumption, energy saving can be achieved.

With the method of fabricating the annular component part, the squeezing operation may be executed upon using a roller held in abutting engagement with an outer circumferential periphery of the cylindrical wall of the annular body.

With such a fabricating method, the inner circumferential periphery of the cylindrical wall is expanded to an inner diameter corresponding to the inner diametric concave portion of the annular body and, thereafter, the cylindrical wall of the annular body is squeezed in a tapered shape using the roller held in abutting contact with the outer periphery of the cylindrical wall of the annular body. Thus, no need arises for forming the inner diametrical concave portion on the inner circumferential periphery of the cylindrical wall of the annular body by cutting operation. Further, a series of operations starting from the first outer diametric blanking operation to the second outer diametric blanking operation can be performed merely upon press forming and roller forming to fabricate the annular component part. Therefore, no need arises for executing cold forging operations as required in the related art practice. This results in no need for executing special operations such as softening and annealing, barrel grinding (for removing oxide scale) and lubrication oil, treatment. This enables work time to be shortened while achieving a reduction in equipment cost and associated surface area, with the resultant improvement in productivity. Also, since no need arises for executing softening and annealing and lubrication oil treatment that result in increased energy consumption, energy saving can be achieved.

With the fabricating method according to the present invention, an annular component part can be fabricated with the resultant shortening of work time and reduction in equipment cost and associated space (surface area). This results in a reduction in productivity and the stop collar, which has the inner diametric concave portion playing a role as an undercut, can be fabricated at low cost. This stop collar can be employed as a movement restricting means to restrict the excessive movement of a pinion carried on an output shaft of a starter.

Another aspect of the present invention provides a die for use in the inner diametric expanding operation conducted in the method according to the present invention. The die may comprise a lower die for holding the annular flange portion of the annular body that is subjected to operations up to the inner diametric chamfering operation, and an upper die movable toward and away from the lower die. The lower die has an annular protrusion available to be fitted to the chamfering annular concave portion of the annular flange portion and operative to hold the annular body under a condition where the chamfering annular concave portion is fitted to the annular protrusion of the lower die. The upper die includes an expanding punch for expanding the inner circumferential periphery of the cylindrical wall to the inner diameter corresponding to that of the inner diametric concave portion, and a holder die for holding the outer periphery of the cylindrical wall during movement of the expanding punch to expand the inner circumferential periphery of the cylindrical wall, the holder die being spring biased to be pressurized toward the lower die and movable along an axis of the annular body and having an inner circumferential periphery, engageable with the outer periphery of the cylindrical wall, and a bottom wall operative to hold the annular flange portion of the annular body before the expanding punch begins to expand the cylindrical wall.

With such a structure of the die, when the cylindrical wall of the annular body is expanded outward in a radial direction using the punch, the outer periphery of the cylindrical wall and the surface of the annular flange portion can be retained with the dies. Stated another way, since the punch is forced into the inner circumferential periphery of the cylindrical wall under a condition where the outer periphery of the cylindrical wall and the surface of the annular flange portion are restricted in fixed places. Thus, no material flows to outside areas from the outer periphery of the cylindrical wall and the surface of the annular flange portion, enabling the prevention of the occurrence of defect caused by inclusion of material.

Further, during the operation to force the punch into the inner circumferential periphery of the cylindrical wall, the chamfering annular concave portion, formed on the end face of the flange portion at the position in opposition to the cylindrical wall, is held in matching engagement with and retained in a fixed place with the annular protrusion of the lower die. This suppress material from flowing from the annular flange portion to the outside area while causing material to be flown to an inward area, enabling the prevention of the occurrence of a shear drop and deformation of the cylindrical wall.

With the die for use in the inner diametric expanding operation conducted in the method according to the present invention, the expanding punch may have an end portion formed with an outer diametric stepped portion for preliminarily forming the annular stepped portion on the inner circumferential periphery of the cylindrical wall in the striation as the deformation start point when executing the squeezing operation.

The outer diametric stepped portion is formed on the expanding punch for preliminarily forming the annular stepped portion on the inner circumferential periphery of the cylindrical wall in the striation as the deformation start point when executing the squeezing operation. This allows the cylindrical wall of the annular body to be squeezed in the tapered shape in a high precision during the squeezing operation without causing the occurrence of any deformation on a shape of the inner diametric concave portion.

Another aspect of the present invention provides a die for use in the inner diametric chamfering operation conducted in the method according the present invention. The die may comprise a lower die for holding the annular flange portion of the annular body that is subjected to operations up to the preliminarily chamfering operation, and an upper die movable toward and away from the lower die. The lower die has an annular protrusion available to be fitted to the chamfering annular concave portion, formed on the annular flange portion of the annular body, and operative to hold the annular body under a condition where the chamfering annular concave portion is fitted to the annular protrusion of the lower die. The upper die includes a chamfering punch for compressing an inner diametric corner area of the distal end of the cylindrical wall to form a chamfer thereon, and a holder die for holding the outer periphery of the cylindrical wall during movement of the chamfering punch, the holder die being spring biased to be pressurized toward the lower die and movable along an axis of the annular body and having an inner circumferential periphery, engageable with the outer periphery of the cylindrical wall, and a bottom wall operative to hold the annular flange portion of the annular body before the chamfering punch begins to form the chamfer on the inner diametric corner area of the cylindrical wall.

With such a structure mentioned above, during operation to compress the inner peripheral corner of the distal end of the cylindrical wall using the punch, the die holds the outer periphery of the cylindrical wall and the surface of the annular flange portion. In other words, the punch compresses the inner peripheral corner of the distal end of the cylindrical wall under a condition where the die restricts the outer periphery of the cylindrical wall and the surface of the annular flange portion. This suppresses material from flowing to the outside area around the outer periphery of the cylindrical wall and the surface of the annular flange portion, enabling the prevention of the occurrence of any defects caused by inclusion of material.

Further, during the operation to compress the inner peripheral corner of the distal end of the cylindrical wall using the punch, the chamfering annular concave portion, formed on the end face of the annular flange portion at a position in opposition to the cylindrical wall, is brought into matching engagement with the annular protrusion of the lower die. This suppresses material from flowing from the annular flange portion to the outside area thereof. As a result, no probability takes place for the cylindrical wall to have an increased inner diameter and the cylindrical wall has no probability to be in shortage of material on a inner diametrical region during subsequent inner diametric expanding operation, thereby preventing the occurrence of deficiency in configuration.

Another aspect of the present invention provides a die for use in the squeezing operation conducted in the method according to the present invention. The die may comprise a lower die for holding the annular flange portion of the annular body that is subjected to operations up to the inner diametric expanding operation. The lower die has an annular protrusion available to be fitted to the chamfering annular concave portion, formed on the annular flange portion of the annular body, and operative to hold the annular body under a condition where the chamfering annular concave portion is fitted to the annular protrusion of the lower die.

With such a structure, during the operation to squeeze the cylindrical wall in the tapered shape using the tapered shape punch, the chamfering annular concave portion, formed on the end face of the annular flange portion at a position in opposition to the cylindrical wall, is brought into matching engagement with the annular protrusion of the lower die. This suppresses material from flowing from the annular flange portion to the outside area thereof. As a result, no probability takes place for the cylindrical wall to have a decreased inner diameter, thereby making it possible for the cylindrical wall in a final shape to have an inner diameter finished in a desired specified range.

DETAILED DESCRIPTION OF PREFERRED EMBODIMENTS

Now, various embodiments for carrying out the present invention are described below in detail with reference to the accompanying drawings. However, the present invention is construed not to be limited to such embodiments described below and a technical concept of the present invention may be implemented in combination with other known technologies or the other technology having functions equivalent to such known technologies.

First Embodiment

FIGS. 1A to 1I illustrate a flow chart for carrying out a method of fabricating an annular component part 1.

Figure 2:
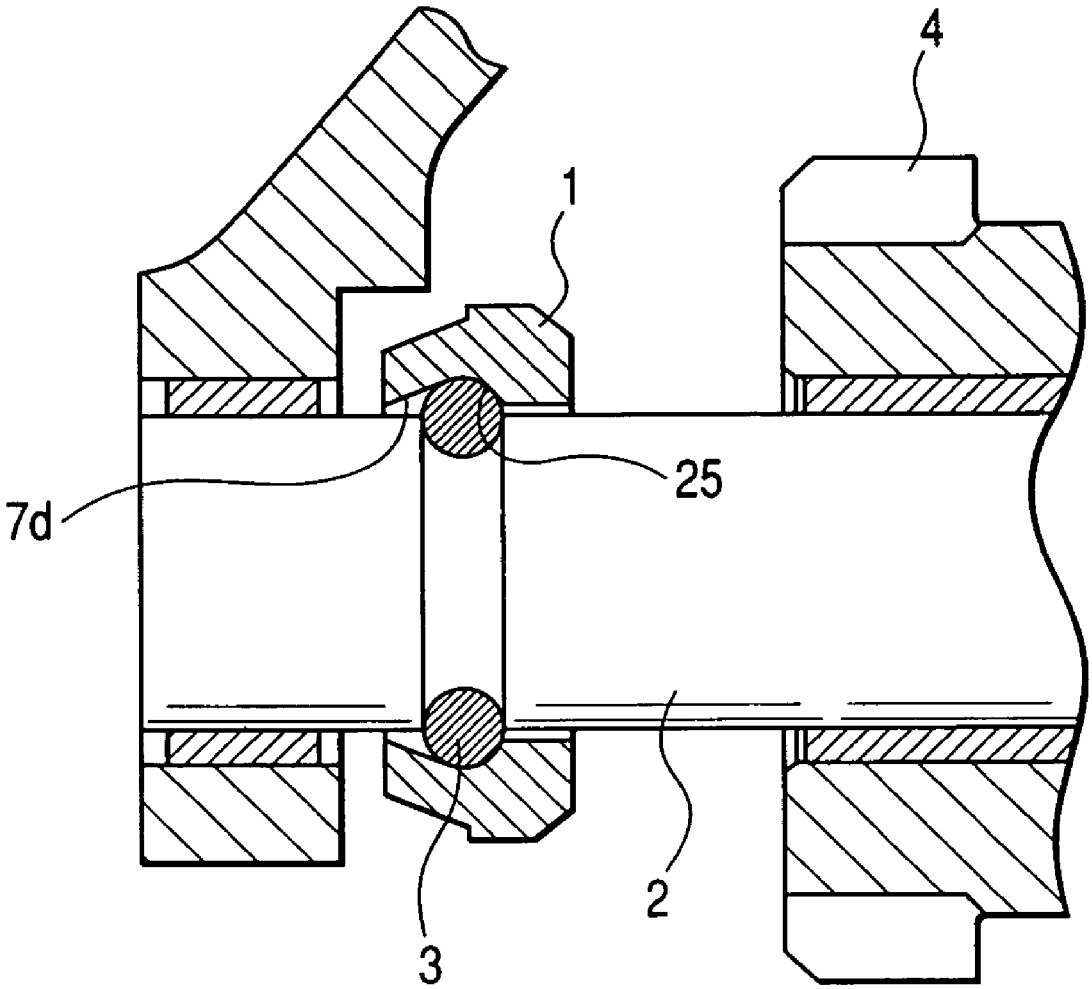
FIG. 2 is a cross-sectional view of a part of a starter having an output shaft carrying thereon a stop collar composed of the annular component part fabricated by the fabricating method shown in FIGS. 1A to 1I.

As shown in FIG. 2, the annular component part 1 of the first embodiment plays a role as, for instance, a stop collar 1 that is mounted on an output shaft 2 of a starter for startup of an engine by means of a snap ring 3 fitted to an outer periphery of the output shaft 2. The output shaft 2 carries thereon a pinion 4 for sliding capability that can be shifted toward (leftward in FIG. 2) a ring gear (not shown) of the engine. The stop collar 1 is used as a movement restriction member that restricts a position for the pinion 4 can move in an axial direction.

Now, a method of fabricating the annular component part 1 of an embodiment according to the present invention is described below with reference to FIGS. 1A to 1I, and FIGS. 3 to 10. FIGS. 3, 5, 7 and 9 show statuses wherein associated upper dies are lifted up upon completion of respective processing.

FIGS. 1A to 1I show a basic sequence of carrying out the method of fabricating the annular component part 1 of the first embodiment. The method of fabricating the annular body of the first embodiment according to the present invention is implemented in a manner described below.

Figure 1A:
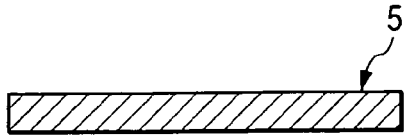
FIGS. 1A to 1I are cross-sectional views showing a basic sequence of carrying out a method of fabricating an annular component part with a first embodiment according to the present invention.

The fabricating method is comprised of the following steps:

(1) First Outer-Diameter Blanking Operation: A sheet of metallic raw material, such as a steel plate, is subjected to blanking operation to form a circular piece 5 using a press-forming machine (not shown) as shown in FIG. 1A.

Figure 1B:
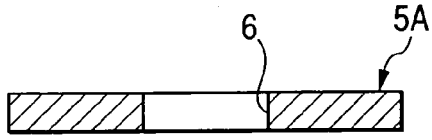

(2) Base Bore Punching Operation: The circular piece 5 is then punched to form a base bore 6 in a radially center position of the circular piece 5 (which will be hereinafter referred to as a workpiece 5A) as shown in FIG. 1B.

Figure 1C:
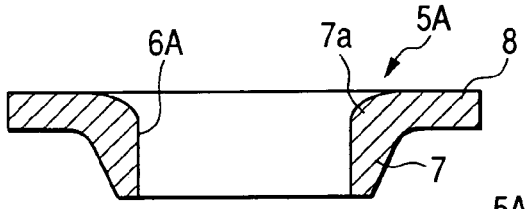

(3) Bore Expanding Operation: A bore expanding die (not shown) is set onto a press-forming machine (not shown) and the workpiece 5A is set onto a die of the press-forming machine. Under such a status, the bore expanding die is lowered to expand the base bore 6 into an expanded bore 6A as shown in FIG. 1C. At the same time, a cylindrical wall 7 is formed on a central area of the workpiece 5A on one side thereof in a thickness direction. Also, the cylindrical wall 7 has a root portion 7*a* that is integrally contiguous with a radially extending annular flange portion 8. The workpiece 5A, obtained during such a bore-expanding step, is also hereinafter referred to as an intermediate body (also referred to as an annular body in the present invention).

Figure 3:
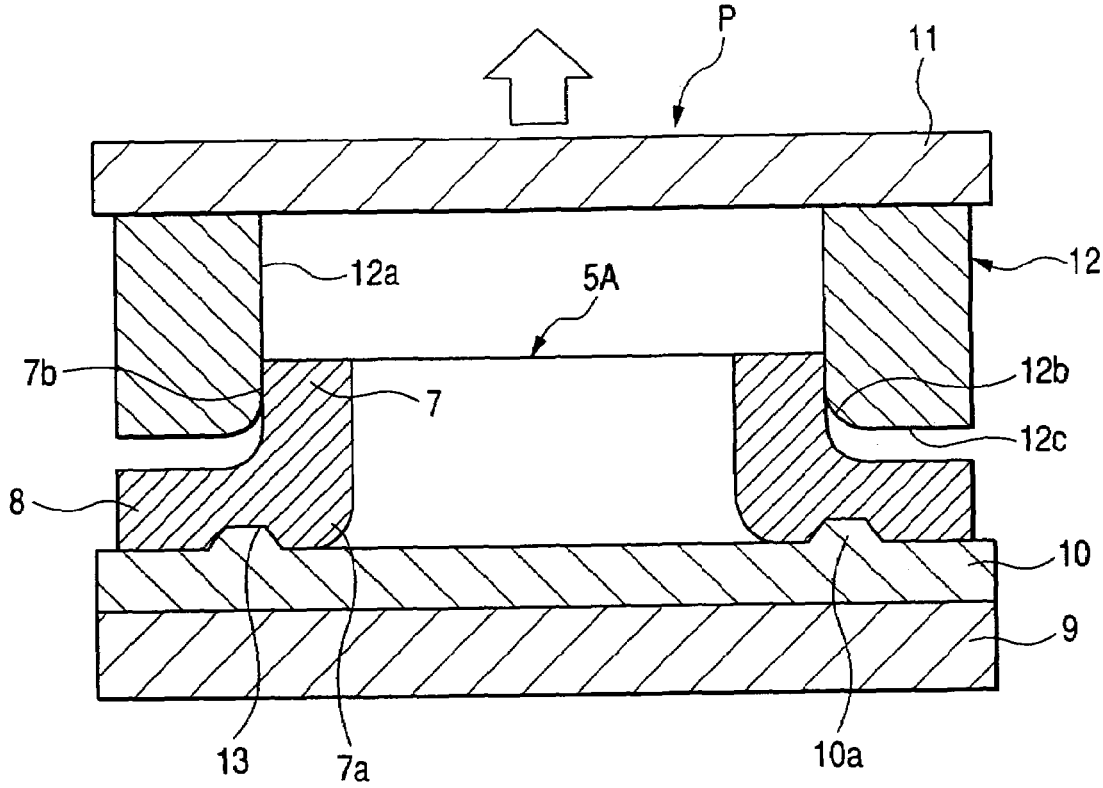
FIG. 3 is a cross-sectional view of a press-forming machine carrying thereon a preliminarily chamfering die for use in preliminarily chamfering to be accomplished on a workpiece.

(4) Preliminarily Chamfering Operation: As shown in FIG. 3, a press-forming machine P has a lower die block 9 that carries thereon a preliminarily chamfering lower die 10. The lower die 10 has an axially extending chamfer forming annular protrusion 10*a* with a view to forming a preliminary chamfer on the intermediate body 5A as will be described later in detail. On the other hand, an upper holder die 12 is mounted on an upper die block 11 of the press-forming machine P in a face-to-face relationship to the lower die 10. The upper holder die 12 has an inner circumferential periphery 12*a*, a curved corner 12*b* and a bottom wall 12*c* for holding the intermediate body 5A in a fixed place during chamfer forming operation executed on a bottom wall of the annular flange portion 8.

Figure 1D:
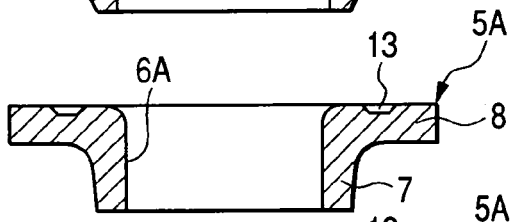

In press forming, the intermediate body 5A is set onto the lower die 10 and, then, the upper die block 11 is lowered upon operating the press-forming machine P to cause the upper holder die 12 to press the annular flange portion 8 of the intermediate body 5A. When this takes place, a chamfering annular concave portion 13 is formed on an overall circumferential area of the annular flange portion 8 of the intermediate body 5A in conformity to a profile of the chamfer forming annular protrusion 10*a* of the lower die 10 as shown in FIG. 1D and FIGS. 3 and 4.

Figure 1E:
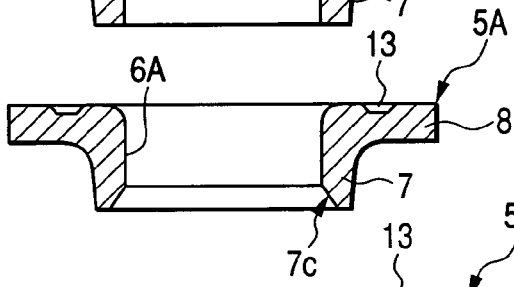
Figure 4:
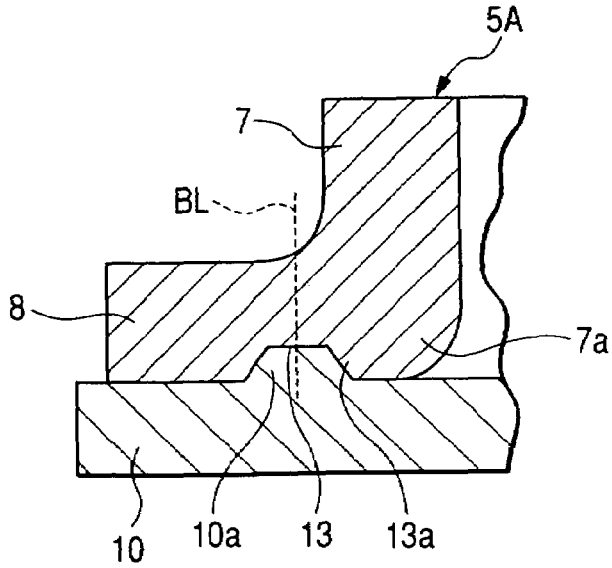
FIG. 4 is an enlarged cross-sectional view of essential parts illustrating the preliminarily chamfering die and associated workpiece in a position at which an outer diametric portion is cut by blanking.

As shown in FIG. 4, the chamfer forming annular protrusion 10*a* is formed on the lower die 10 at a position to allow a bottom surface of the annular flange 8 of the intermediate body 5A to be formed with the chamfering annular concave portion 13 with a chamfer portion 13*a*. With the presence of the chamfering annular concave portion 13 formed with the chamfer portion 13*a*, when the annular flange portion 8 of the intermediate body 5A is cut along with a cutting line indicated by a dotted line BL in FIG. 4 in subsequent blanking operation, the intermediate body 5A is enabled to have an outer cylindrical wall whose annular corner is formed with a chamfer 14 on a final stage as shown in FIG. 1I. Thus, the chamfer forming annular protrusion 10*a* of the chamfering lower die 10 may be suffice to have a suitable shape such as a trapezoid in cross section to allow a final product to have an outer circumferential corner area formed with a suitable chamfer 14 as shown in FIG. 1I when the intermediate body 5A is subjected to second banking operation into a final shape.

Figure 5:
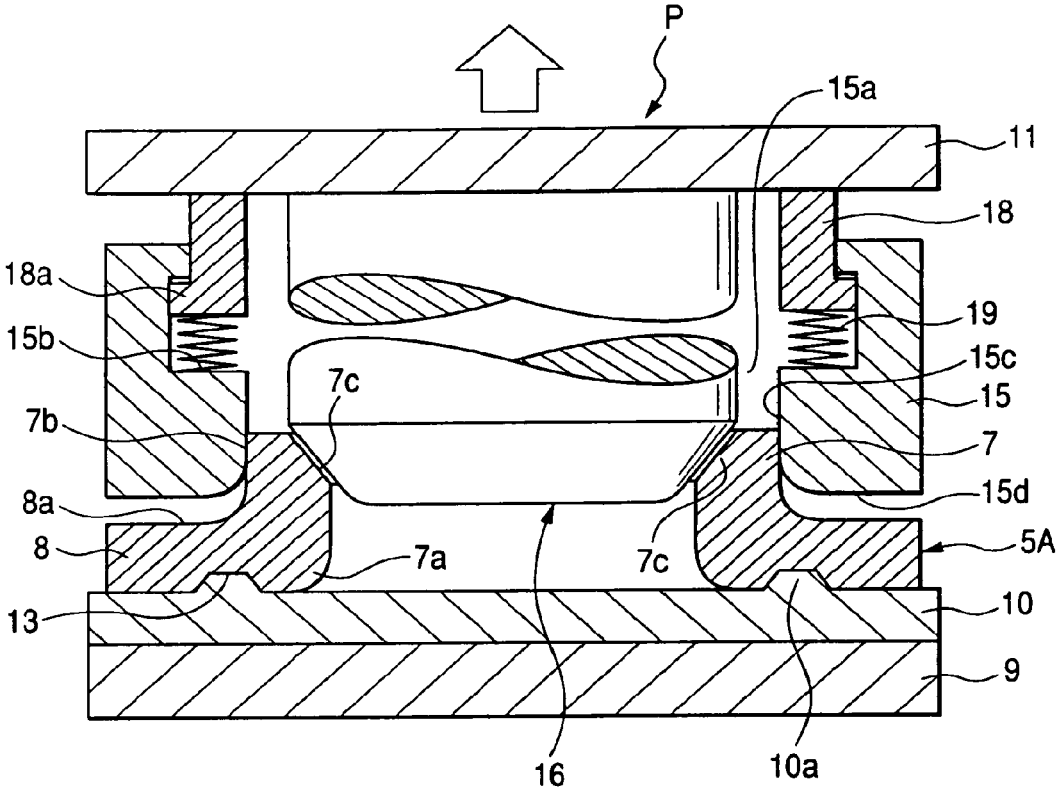
FIG. 5 is a cross-sectional view of the press-forming machine carrying thereon an inner diametric chamfering die for use in chamfering an inner corner area of a cylindrical wall of the workpiece.

(5) Inner Diameter Chamfering Operation: As shown in FIG. 5, the upper die block 11 has a downwardly extending arm portion 18 formed with an outwardly extending radial projection 18*a* in sliding engagement with an annular cavity 15*a* formed on an inner circumferential periphery 15*c* of a cylindrical workpiece holder die 15 that has a bottom wall 15*d* available to hold the annular flange portion 8 of the workpiece 5A. The inner circumferential periphery 15*c* of the cylindrical workpiece holder die 15 serves to hold the outer circumferential wall 7*b* of the cylindrical wall 7 of the workpiece 5A during chamfering operation.

A coil spring 19 is disposed in the annular cavity 15*a* of the holder die 15 between the radial projection 18*a* and a lower annular shoulder 15*b* of the workpiece holder die 15. A chamfering punch die 16 is mounted on a bottom wall of the upper die block 11 and has a lower end formed with a chamfering slant wall 16*a*. In chamfering operation, the workpiece 5A is set onto the lower die 10 so as to allow the concave portion 13 of the workpiece 5A in matching engagement with the chamfer forming annular protrusion 10*a* of the lower die 10 of the lower die 15.

Figure 6:
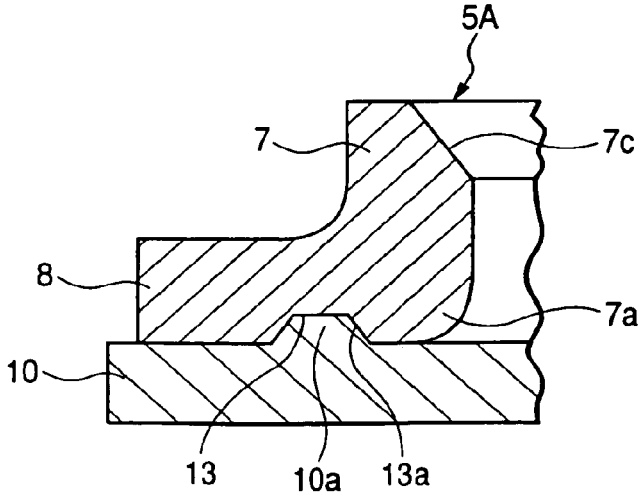
FIG. 6 is an enlarged cross-sectional view of essential parts illustrating the chamfering die and associated workpiece having the cylindrical wall including the inner corner area formed with a chamfer.

In operation, the workpiece holder die 15 is moved downward as viewed in FIG. 5 to allow the inner circumferential periphery 15*c* of the workpiece holder die 15 to be brought into sliding engagement with the outer circumferential wall 7*b* of the cylindrical wall 7. At this moment, the chamfering slant wall 16*a* of the chamfering punch die 16 is caused to press against an inner peripheral corner of the cylindrical wall 7 of the workpiece 5A, thereby compressing the inner peripheral corner of the cylindrical wall 7 to form an annular chamfered portion (chamfered edge) 7*c* at the inner peripheral corner of the cylindrical wall 7 as shown in FIG. 1E and FIG. 6. As set forth above, moreover, the workpiece holder die 15 is supported with the arm portion 18 fixed to the upper die block 11 for upward or downward movements.

During pressing operation, therefore, the workpiece holder die 15 is brought into engagement with the outer circumferential wall 7*b* of the cylindrical wall 7 to hold the outer circumferential wall 7*b* thereof before the chamfering slant wall 16*a* of the chamfering punch die 16 begins to compress the inner peripheral corner of the cylindrical wall 7 while permitting the bottom wall 15*d* of the workpiece holder die 15 to preliminarily pressurize an upper surface of the annular flange portion 8 of the workpiece 5A due to a load exerted by the spring 19 interposed between the arm portion 18 and the workpiece holder die 15.

In other words, as the upper die block 11 is lowered upon operation of the press-forming machine P, the workpiece holder die 15 surely hold the outer circumferential wall 7*b* of the cylindrical wall 7 and the upper surface 8*a* of the annular flange portion 8 and, then, the chamfering punch die 16 is caused to compress the inner peripheral corner of the cylindrical wall 7 at the upper distal end thereof thereby forming the annular chamfered portion 7*c* as shown in FIG. 1E. Also, the annular chamfered portion 7*c* of the cylindrical wall 7 may take the form of not only a C-chamfered edge but also another shape such as R-chamfered edge.

Figure 7:
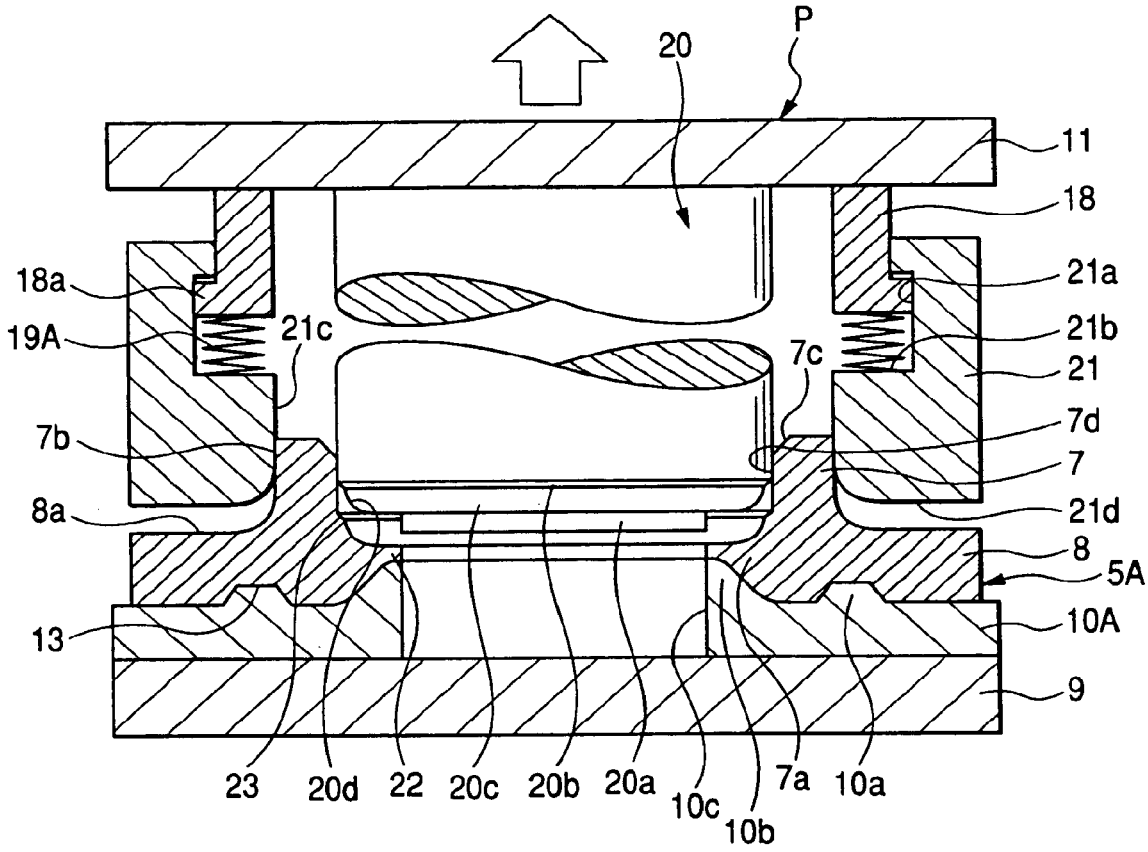
FIG. 7 is a cross-sectional view of the press-forming machine carrying thereon an inner diametric expanding die for use in expanding an inner diameter of the cylindrical wall of the workpiece.

(6) Inner Diameter Expanding Operation: The upper die block 11 of the press-forming machine P carries thereon an arm portion 18, formed with an outwardly extending radial projection 18*a*, which supports a cylindrical workpiece holder die 21 having an inner annular cavity 21*a* with which the outwardly extending radial projection 18*a* of the arm portion 18 is held in sliding engagement as shown in FIG. 7. The workpiece holder die 21 has a bottom wall 21*d* available to hold the annular flange portion 8 of the workpiece 5A. An inner circumferential periphery 21*c* of the cylindrical workpiece holder die 21 serves to hold the outer circumferential wall 7*b* of the cylindrical wall 7 of the workpiece 5A during inner diametric expanding operation.

A coil spring 19A is disposed in the annular cavity 21*a* of the holder die 21 between the radial projection 18*a* of the arm portion 18 and a lower annular shoulder 21*b* of the workpiece holder die 21.

An inner diametric expanding die 20 is mounted on the bottom wall of the upper die block 11 of the press-forming machine P and has a lowermost end formed with a downwardly extending cylindrical protrusion 20*a* that is contiguous with an outer diametric stepped portion 20*b* via an intermediate portion 20*c*. With a view to expanding an inner diameter of the cylindrical wall 7 of the workpiece 5A, the inner diametric expanding die 20 has a lower end larger in outer diameter than that of the inner wall 7*d* of the cylindrical wall 7.

A lower die 10A has, in addition to an annular protrusion 10*a*, a trapezoid portion 10*b* formed with an axial bore 10*c* for escaping the cylindrical protrusion 20*a* of the 20 inner diametric expanding die 20.

In inner diameter expanding operation, the workpiece 5A is set onto the lower die with the concave portion 13 of the workpiece 5A in matching engagement with the chamfer forming annular protrusion 10*a* of the lower die 10 of the workpiece holder die 15. Then, the workpiece holder die 21 is moved downward as viewed in FIG. 7 to allow the inner circumferential periphery 21*cc* of the workpiece holder die 21 to be brought into sliding engagement with the outer periphery 7*b* of the cylindrical wall 7.

During such inner diameter expanding operation, the workpiece holder die 21 is brought into engagement with the outer circumferential wall 7*b* of the cylindrical wall 7 to hold the same before a lower end of the inner diameter expanding die 20 begins to be forced into the inner circumferential periphery 7*d* of the cylindrical wall 7.

During further downward movement of the inner diameter expanding die 20, the expanding die 20, fixedly mounted on the bottom wall of the upper die block 11, is forced into the inner circumferential periphery 7*d* of the cylindrical wall 7 of the workpiece 5A thereby expanding the inner circumferential periphery 7*d* of the cylindrical wall 7 in a radially outward direction.

During such downward movement of the expanding die 20, the outer circumferential wall 7*b* of the cylindrical wall 7 of the workpiece 5A is held by the inner circumferential periphery 21*c* of the workpiece holder die 21 that is radially placed outward of the expanding punch die 20 so as to form the cylindrical wall 7 in a uniform wall thickness along an axis thereof.

The workpiece holder die 21 is supported with the arm portion 18, fixedly mounted on the bottom wall of the upper die block 11, for upward and downward moving capability by means of the spring 19A. With such a structure, during downward movement of the upper die block 11 of the press-forming machine P, the workpiece holder die 21 surely hold the outer circumferential wall 7*b* of the cylindrical wall 7 and the upper surface 8*a* of the annular flange portion 8 of the workpiece 5A is held in a fixed place by a bottom wall 21*d* of the expanding die 21 by means of the spring 19A.

Figure 1F:
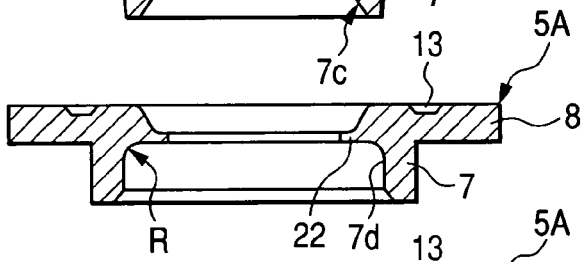

Then, the expanding die 20 is forced into the inner peripheral corner 7*b* of the cylindrical wall 7 of the workpiece 5A thereby expanding the inner diameter of the workpiece 5A into an increased diameter configuration as shown in FIG. 1F. During such inner diameter expanding operation, due to the presence of the outer diametric stepped portion 20*b* formed on the inner diameter expanding die 20, the intermediate portion 20*c* and the cylindrical protrusion 20*a* of the inner diameter expanding die 20 while the outer periphery 7*b* of the cylindrical wall 7 of the workpiece 5A is retained by the inner circumferential periphery 21*c* and the bottom wall 21*d* of the workpiece holder die 21, the inner circumferential corner portion 7*a* of the cylindrical wall 7 is pressed between the intermediate portion 20*c* of the inner diameter expanding die 20 and a trapezoid protrusion 10*b* of a lower die 10A.

The inner circumferential corner portion 7*a* of the cylindrical wall 7 is caused to flow in a radially inward position to form an inner annular flange portion 22. At this moment, the cylindrical protrusion 20*a* of the inner diameter expanding punch 20 is brought into abutting contact with an upper surface of the trapezoid protrusion 10*b* of the lower die 10, thereby specifying an inner diameter of inner annular flange portion 22.

Figure 8:
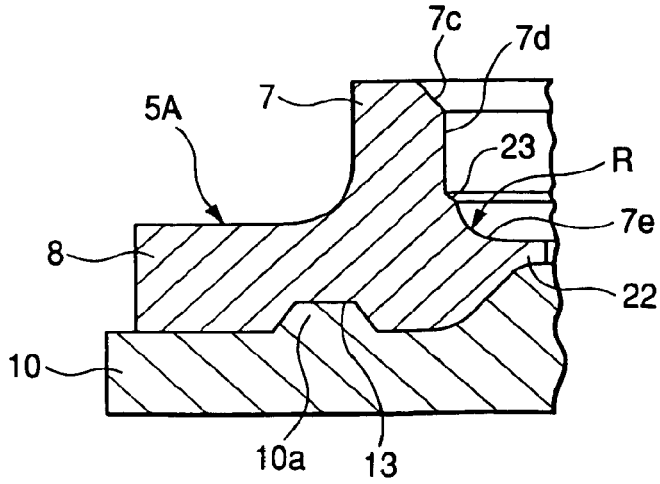
FIG. 8 is an enlarged cross-sectional view of essential parts illustrating the workpiece with the cylindrical wall being expanded in inner diameter and formed with an annular stepped portion and an annular shoulder (concave) portion.

Further, the inner diameter expanding die 20 used in the present step has the intermediate portion 20*c* whose annular corner 20*d* has an R-shape. As a result, as shown in FIG. 8, an annular shoulder 7*e* is formed in an area between the inner circumferential periphery 7*d* and the inner annular flange portion 22 of the cylindrical wall 7 of the workpiece 5A and has an R-shape corresponding to ¼ of a circumference.

In addition, with the present step, an annular stepped portion 23 is preliminarily formed on an entire inner circumferential periphery 7*d* of the cylindrical wall 7 in a striation to play a role as a deformation starting point to facilitate tapering deformation of the cylindrical wall 7 at a proper position during a squeezing cycle of the cylindrical wall 7 in a subsequent step (during a squeezing cycle). The annular stepped portion 23 is formed by the outer diametric stepped portion 20*b* formed on the outer periphery of the inner diameter expanding die 20 adjacent to the intermediate portion 20*c*. That is, inner diameter expanding operation and striation-shaped annular stepped portion forming operation, enabling the formation of the deformation starting point for the tapered profile of the cylindrical wall 7 of the workpiece 5A, can be performed at one time with the use of the inner diameter expanding punch 20 in a single press forming operation.

Figure 1G:
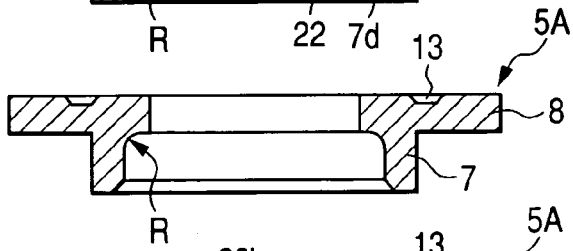

(7) Inner Diametric Punching Operation: The workpiece 5A is set onto the press-forming machine and a punching die is set to the upper die block of the press-forming machine with the workpiece 5A for punching the inner diametric annular portion 22 of the workpiece 5A. This allows the workpiece 5A to have an inner bore 22*b* with an increased diameter, in a size available to be suitably fitted to the output shaft 2 of the starter (see FIG. 2), as shown in FIG. 1G.

Figure 9:
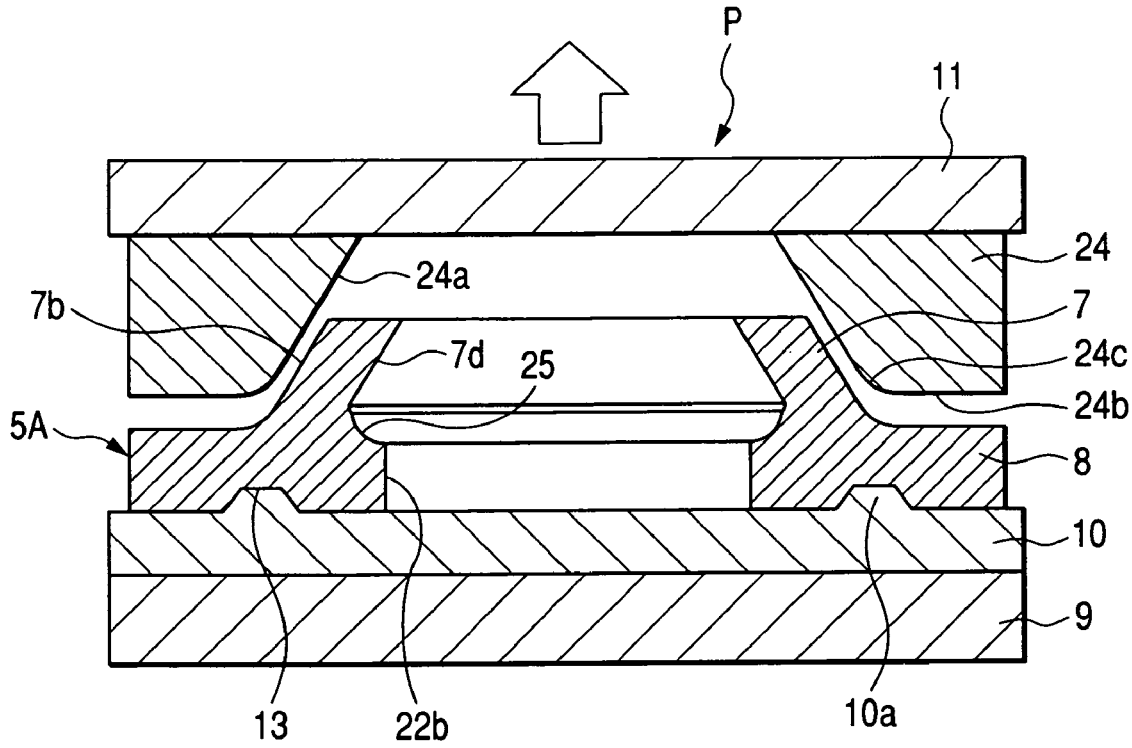
FIG. 9 is a cross-sectional view of the press-forming machine carrying thereon a squeezing die for use in squeezing the cylindrical wall of the workpiece in a tapered profile.

(8) Aperture Squeezing Operation: As shown in FIG. 9, with the punch press-forming machine P, the upper die block 11 carries a squeezing die 24 formed with a tapered inner wall 24*a* starting from a bottom wall 24*b*, playing a role as a holder surface, and having a gradually decreased diameter along an axis of the squeezing die 24. The squeezing die 24 has an annular shoulder portion 24*c* with a given radius of curvature between a bottom wall 24*b* and the tapered inner wall 24*a*.

The lower die block 9 carries thereon the lower die 10 having the chamfer forming annular protrusion 10*a* for the positioning of the workpiece 5A in a fixed position. In carrying out the squeezing step, the workpiece 5A is set onto the lower die 10 in matching engagement between the annular concave portion 13 of the workpiece 5A and the chamfer forming annular protrusion 10*a* of the lower die 10.

Figure 1H:
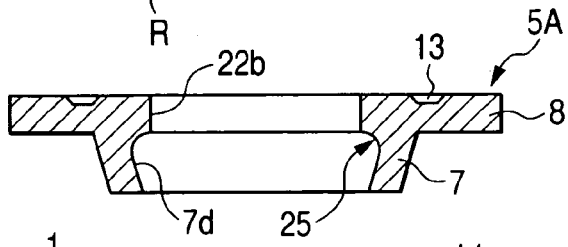
Figure 1I:
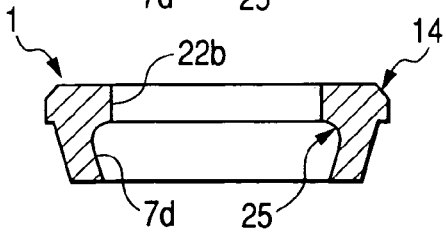

In squeezing operation, the press-forming machine P is operated to lower the squeezing die 24 toward the workpiece 5A while causing the inner tapered wall 24*a* of the squeezing die 24 to be held in abutting engagement with the outer periphery of the cylindrical wall 7 of the workpiece 5A. During downward movement of the squeezing die 24, the tapered inner wall 24*a* of the squeezing die 24 progressively squeezes the outer periphery of the cylindrical wall 7 to cause the deformation thereof to occur in a tapered profile thereby accomplishing the squeezing step such that the outer peripheral wall 7*b* and the inner circumferential periphery 7*d* of the cylindrical wall 7 are gradually tapered in decreasing diameter as shown in FIG. 1H and FIGS. 9 and 10.

Figure 10:
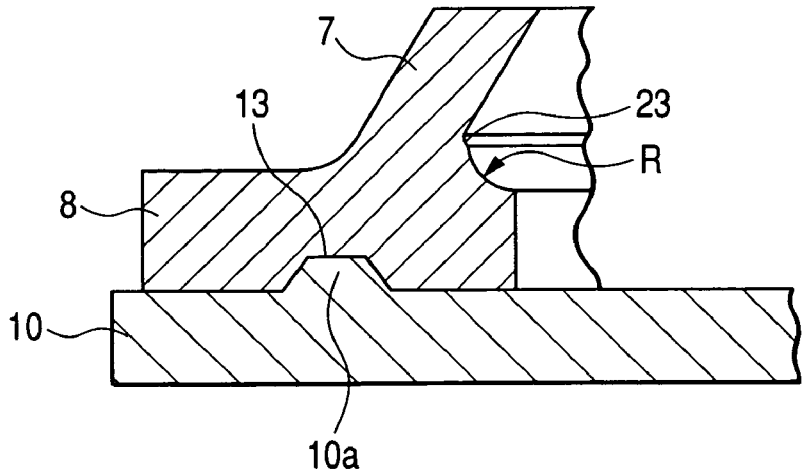
FIG. 10 is an enlarged cross-sectional view of essential parts illustrating the workpiece with the cylindrical wall being tapered and formed with the annular stepped portion and the annular shoulder (concave) portion.
Figure 11:
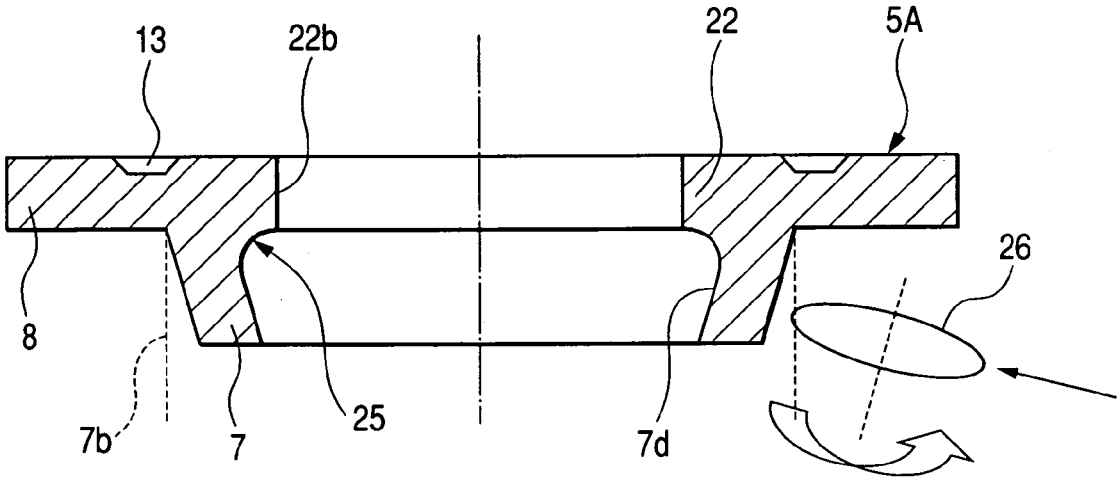
FIG. 11 is an enlarged cross-sectional view of an annular component part produced by a fabricating method of another embodiment according to the present invention.

When this takes place, as shown in FIG. 10, the cylindrical wall 7 of the workpiece 5A is subjected to plastic deformation in a tapered form with a starting point defined by the annular stepped portion 23 formed on the inner circumferential periphery 7*d* of the cylindrical wall 7 in a preceding step (inner diametric expanding step). This allows the annular shoulder 7*e*, formed in the R-shape resulting from the preceding inner diametric expanding step, to be configured in an undercut shape thereby forming an inner diametric concave portion 25 as shown in FIG. 1I and FIG. 11. The inner diametric concave portion 25 is brought into mating engagement with an outer periphery of the snap ring 3 (see FIG. 2).

(9) Second Outer Diametric Blanking Step: The workpiece 5A, having a structure formed by press forming as shown in FIG. 1H, is set onto a lower die (not shown) of the press-forming machine and an outer diametric punching die is set onto an upper die block of the press-forming machine. Under such a state, the outer diametric punching die is lowered upon operation of the press-forming machine to cut the annular flange portion 8 of the workpiece 5A at the position (along with the line BL as shown FIG. 4) crossing the chamfering annular concave portion 13 formed over the entire circumference of the end face of the annular flange portion 8 of the workpiece 5A in the preceding preliminarily chamfer forming step to form the workpiece 5A in a size with an outer diameter on a final stage as shown in FIG. 1I.

Advantageous Effects of First Embodiment

With the fabricating method of the present embodiment according to the present invention, the inner diametric expanding step is carried out expanding the inner circumferential periphery of the cylindrical wall 7 of the workpiece 5A after which the squeezing step is conducted on the workpiece 5A to squeeze the cylindrical wall 7 thereof in the tapered form. This enables the inner circumferential periphery of the cylindrical wall 7 to be formed with the inner diametric concave portion 25 that plays a role as the undercut portion. Therefore, the inner diametric concave portion 25 of the cylindrical wall 7 has no need to be formed by cutting. Further, a series of work operations from the first outer diametric blanking step to the second diametric punching step can be accomplished only by press working and no need arises for carrying out cold forging as required in the related art practice. Therefore, no specified processing step is required to carry out operations such as softening and annealing, barrel grinding (for removing oxidized scale), lubrication film treatment, etc. This results in capability of shortening the processing time and reduction in equipment cost and occupied surface area with the resultant increase in productivity.

With a fabricating method of the related art for fabricating the annular component part 1, shown in FIG. 2, with the use of cold forging step, there is a need for carrying out softening and annealing step and lubrication film treatment that result in large consumption of energy. On the contrary, with the fabricating method of the present embodiment according to the present invention, the annular component part 1 can be fabricated through the use of only press working. This results in a reduction of energy consumption, thereby contributing to saving of energy consumption.

With the fabricating method of the first embodiment, the inner circumferential periphery 7*d* of the cylindrical wall 7 of the workpiece 5A is preliminarily formed with the annular stepped portion 23 in striation prior to the squeezing step, thereby permitting the cylindrical wall 7 of the workpiece 5A to be squeezed in a tapered shape with the start point (deformation start point) at the annular stepped portion 23. Therefore, the press forming can be accomplished with high precision to allow the inner circumferential periphery 7*d* of the cylindrical wall 7 to be formed with the inner diametric concave portion 25 in the R-shape without causing any deformation in the R-shape of the inner diametric concave portion 25 during the squeezing formation of the cylindrical wall 7.

Further, during the squeezing step, compressive stress concentrates on an inner corner area of a distal end of the cylindrical wall and suffers from compressive strain when conducting the squeezing step to form the cylindrical wall 7 in the tapered shape, resulting in the occurrence of compressive wrinkling in a crack-shape. The occurrence of compressive wrinkling results in deterioration of product strength while causing a remarkable drop in product quality. On the contrary, with the fabricating method of the present embodiment, the chamfer forming operation is carried out upon compressing the inner peripheral corner area of the distal end of the cylindrical wall 7 in a preceding stage before the squeezing step is performed. This enables a reduction in stress concentration acting on the inner peripheral corner area of the distal end of the cylindrical wall 7 during the squeezing step for the cylindrical wall 7 to be formed in the tapered profile. This enables the prevention of the occurrence of compressive wrinkling in the crack shape. Also, while the cylindrical wall 7 has been shown as having the annular chamfered portion 7*c* in a straight line in FIG. 6, it will be appreciated that the annular chamfered portion 7*c* of the cylindrical wall 7 may take the form of any one of a C-chamfered shape or an R-chamfered shape.

With the fabricating method of the present embodiment, moreover, carrying out the chamfer forming operation before the inner diametric expanding step enables the chamfered portion 7*c*, formed on the distal end of the cylindrical wall 7 at the inner peripheral corner area, to be utilized as a guide surface for guiding the expanding punch die 20 into the inner circumferential periphery 7*d* of the cylindrical wall 7 during the inner diametric expanding step. That is, no interference occurs between the inner peripheral corner area of the distal end of the cylindrical wall 7 and the expanding punch die 20 and the expanding punch die 20 can be smoothly guided into the inner circumferential periphery 7*d* of the cylindrical wall 7. This results in an advantageous effect of smoothly carrying out the inner diametric expanding step.

Furthermore, with the second outer diametric blanking step, the annular flange portion 8 of the workpiece 5A can be cut along the chamfering annular concave portion 13, preliminarily formed in the preliminarily chamfering step, into a final shape by blanking. This enables the annular component part 1 to have an outer corner area formed with a chamfered surface 14 (see FIG. 1I). In this case, even if burrs occur on the workpiece with an outer diameter in a final shape, no probability takes place for such burrs to protrude outward from an end face (an end face in opposition to the cylindrical wall) of the annular component part 1. This enables the pinion 4 from riding over the burrs when the pinion 4 is caused to move toward the ring gear of the engine and brought into abutting engagement with an end face of the stop collar 1 in a case where the annular component part 1 is employed as the stop collar 1 as shown in FIG. 2.

Moreover, the chamfering annular concave portion 13 is formed prior to the inner diametric expanding step, making it possible to perform the inner diametric chamfering operation, the inner diametric expanding operation and the squeezing operation under a condition where the chamfering annular concave portion 13 of the annular flange portion 8 is held in matching engagement with the chamfer forming annular protrusion 10*a* of the lower die 10. This restricts the material of the annular flange portion 8 of the workpiece 5A from moving in an outer peripheral direction during the operation to compress the inner corner area of the distal end of the cylindrical wall 7 using the chamfering punch die 16. As a result, an inner diameter of the cylindrical wall 7 can be prevented from increasing in dimension. Therefore, no probability occurs for the inner circumferential periphery 7*d* of the cylindrical wall 7 to be short in material during the inner diametric expanding operation in a subsequent step, thereby avoiding the occurrence of defective configuration.

Also, during the inner diametric expanding operation, the expanding punch 20 is forced into the inner circumferential periphery 7*d* of the cylindrical wall 7 thereby expanding the cylindrical wall 7 in a radially outward direction. At this moment, no raw material flows out of the annular flange portion 8 of the workpiece 5A in an outward area. Thus, no shear drop or deformation can take place on the cylindrical wall 7 of the workpiece. As a result, the R-shape of the inner diametric concave portion 25 can be formed in high precision.

In addition, the squeezing operation can be performed so as to suppress the material of the annular flange portion 8 from moving radially inward to form the cylindrical wall 7 in the tapered profile using the tapered punch 24. This enables the prevention of a decrease in an inner diametric dimension, making it possible to fabricate the annular component part 1 with an inner diameter finished in a given specified range.

The work holding die 15, to be used in the inner diametric expanding step, and the work holding die 21, to be used in the inner diametric chamfering step, are supported with the arm portion 18, fixedly mounted on the bottom wall of the upper die block 11, by means of the spring 19 so as to be movable upward or downward. Therefore, the inner diametric chamfering step can be performed to allow the chamfering punch die 16 to compress the inner diametric corner 7*b* of the cylindrical wall 7 of the workpiece 5A under a circumstance where the work holding die 15 restricts the outer circumferential wall 7*b* of the cylindrical wall 7 and the surface of the annular flange portion 8.

Likewise, the inner diametric expanding step can be performed to force the expanding punch die 20 into the inner circumferential periphery 7*d* of the cylindrical wall 7 under a circumstance where the work holding die 21 restricts the outer circumferential wall of the cylindrical wall 7 and the surface of the annular flange portion 8. As a result, during both press forming steps, no material flows toward the outer circumferential wall of the cylindrical wall 7 and the annular flange portion 8, thereby preventing the occurrence of defect caused by the material got into another area.

Also, it is to be appreciated that the fabricating steps (1) to (9) described above with reference to the first embodiment can be suitably altered within a range available for the R-shape of the inner diametric concave portion 25, playing a role as the undercut, to be formed in a high precision. For instance, while the preliminarily chamfering step has been described above as being conducted before the inner diametric chamfering operation, the preliminarily chamfering step may be conducted after or before the inner diametric expanding operation. Similarly, the inner diametric chamfering operation may be carried out after the inner diametric expanding operation or before the squeezing operation.

Besides, while the first embodiment has been set forth above with reference to a process wherein, for the purpose of employing the annular component part 1 as the stop collar 1, the inner diametric punching operation is carried out after the inner diametric expanding operation, the inner diametric punching operation may be omitted provided that no restriction is present in dimension of an inner diameter of an intended component part.

Second Embodiment

FIG. 11 is a cross-sectional view of an annular component part 1 (stop collar) obtained by an annular component part fabricating method of a second embodiment according to the present invention.

While with the first embodiment, the squeezing operation is implemented using the tapered squeezing punch 24 as shown in FIG. 9, the second embodiment features to achieve squeezing operation using a roller 26 as shown in FIG. 11. That is, the roller 26, held in abutting engagement with the outer peripheral wall 7*b* of the cylindrical wall 7 of the workpiece 5A, is rotated causing the cylindrical wall 7 to be progressively deformed into a tapered profile.

Also, the second embodiment has the same steps as those of the first embodiment except for the squeezing step. Even with the method of the second embodiment, no need arises to employ a cutting process to form the inner diametric concave portion 25 forming the undercut. In addition, the fabricating method of the second embodiment can fabricate the annular component part 1 merely by press forming (including the first diametric blanking step, the base bore forming step, the base bore expanding step, the preliminarily chamfering step, the inner diametric chamfering step, the inner diametric expanding step and the second diametric punching step except for the squeezing step). Thus, no need arises for employing a forging step as required in the related art practice, enabling the shortening of work time and reduction in equipment expenses and associated surface areas while providing improved productivity.

FIRST REFERENCE EXAMPLE

FIGS. 12A to 12E are views for illustrating a diagram of another method of fabricating an annular component part 1B playing a role as a stop collar in accordance with a first reference example.

While the first embodiment has been described above with reference to the process wherein the annular component part 1 is fabricated based on the plate-like raw material 5 using press forming, the first reference example shows an example in which the annular component part 1B is fabricated from a bar steel 27.

The fabricating method of such a first reference example is described below with reference to FIGS. 12A to 12E.

The fabricating method includes steps described below.

(1) Cutting Step: The bar steel 27 is cut into a given length to form a steel bar member 28 made of raw material.

(2) Softening and Annealing Step: The steel bar member 28 made of hardened material is annealed and softened.

(3) Barrel Grinding Step: Barrel grinding is conducted to remove oxidized scale from a surface of the steel bar member 28.

(4) Lubrication Film Treatment Step: The surface of the steel bar member 28 is subjected to bonderizing treatment to form a phosphoric acid film on the surface of the steel bar member 28.

Figure 12A:
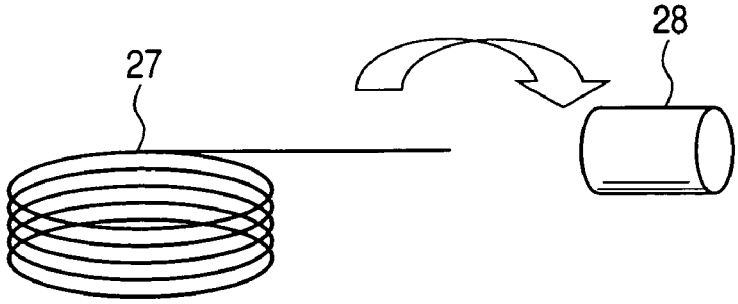
FIGS. 12A to 12E are views showing a method of fabricating an annular component part of a reference example.
Figure 12B:
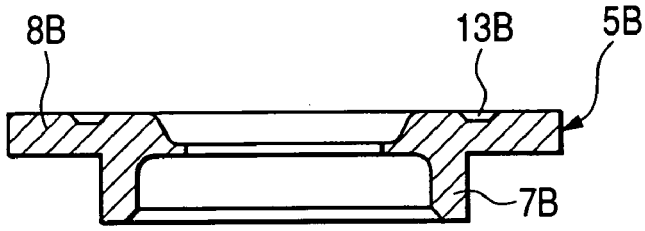

(5) Cold Forging Step: Cold forging extrusion forming is carried out on the steel bar member 28 to form a workpiece 5B with a cylindrical wall 7B and an annular flange portion 8B, which is similar to the cylindrical wall 7 and the annular flange portion 8 of the workpiece 5A of the first embodiment, as shown in FIG. 12B.

Figure 12C:
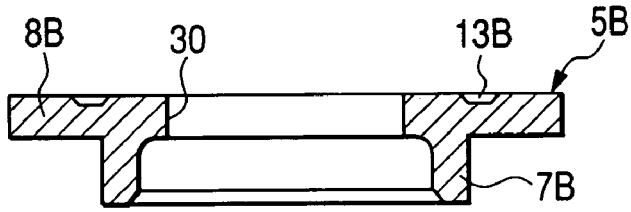

(6) Inner Diametric Punching Step: The workpiece 5B, resulting from the cold forging step, is punched to form an inner diameter 30 (in the same manner as the inner diametric punching step of the first embodiment) as shown in FIG. 12C.

Figure 12D:
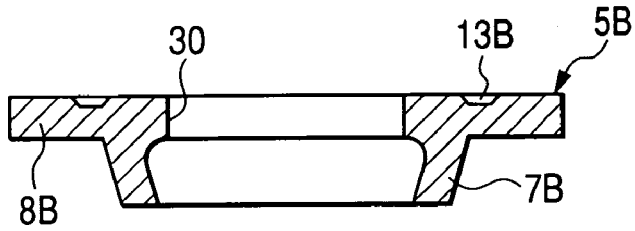

(7) Aperture Squeezing Step: The cylindrical wall 7B is subjected to squeezing operation to form the cylindrical wall 7B in a tapered profile (in the same step as the squeezing step of the fabricating method of the first and second embodiments) as shown in FIG. 12D.

Figure 12E:
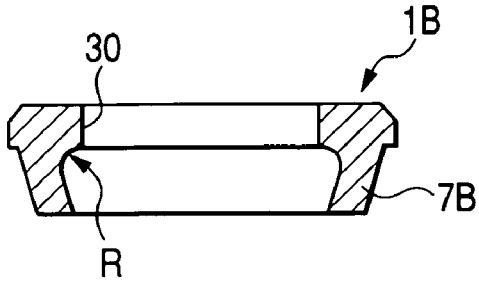

(8) Outer Diametric Blanking Step: The annular flange portion 8B of the workpiece 5B is cut by blanking along an area associated with a chamfering annular concave portion 13B formed in the preceding cold forging step in a diameter of a final profile of the annular component part 1B (in the same step as the outer diametric blanking step of the fabricating method of the first and second embodiments) as shown in FIG. 12E.

SECOND REFERENCE EXAMPLE

FIGS. 13A to 13E are views showing still another method of fabricating an annular component part 1C playing a role as a stop collar in accordance with a second reference example.

The second reference example shows an example wherein an annular shoulder portion 25C, forming an undercut, is cut and formed.

The fabricating method of such a first reference example is described below with reference to FIGS. 13A to 13E.

The fabricating method includes steps described below.

Figure 13A:
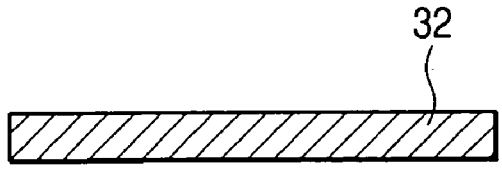
FIGS. 13A to 13E are views showing a method of fabricating an annular component part of another reference example.

(1) Outer Diametric Blanking Step: A plate-like raw material 32, such as steel plate, is formed by blanking in a circular profile using a press-forming machine (not shown) to obtain a workpiece 5C (in the same step as the first diametric punching step of the fabricating method of the first embodiment) as shown in FIG. 13A.

Figure 13B:
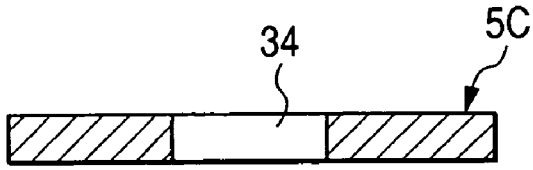
Figure 13C:
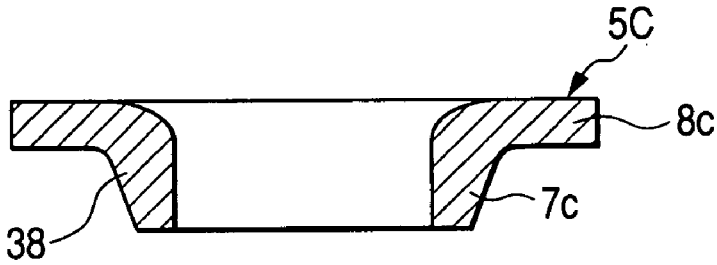
Figure 13D:
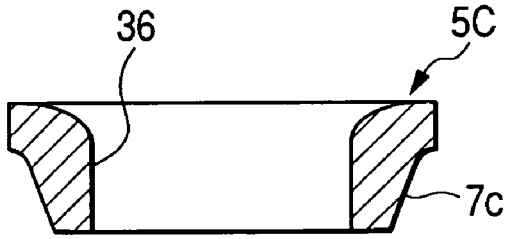
Figure 13E:
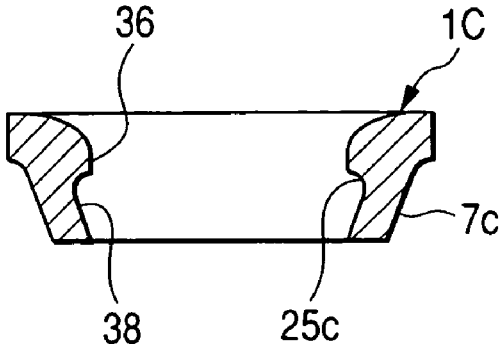
Figure 14:
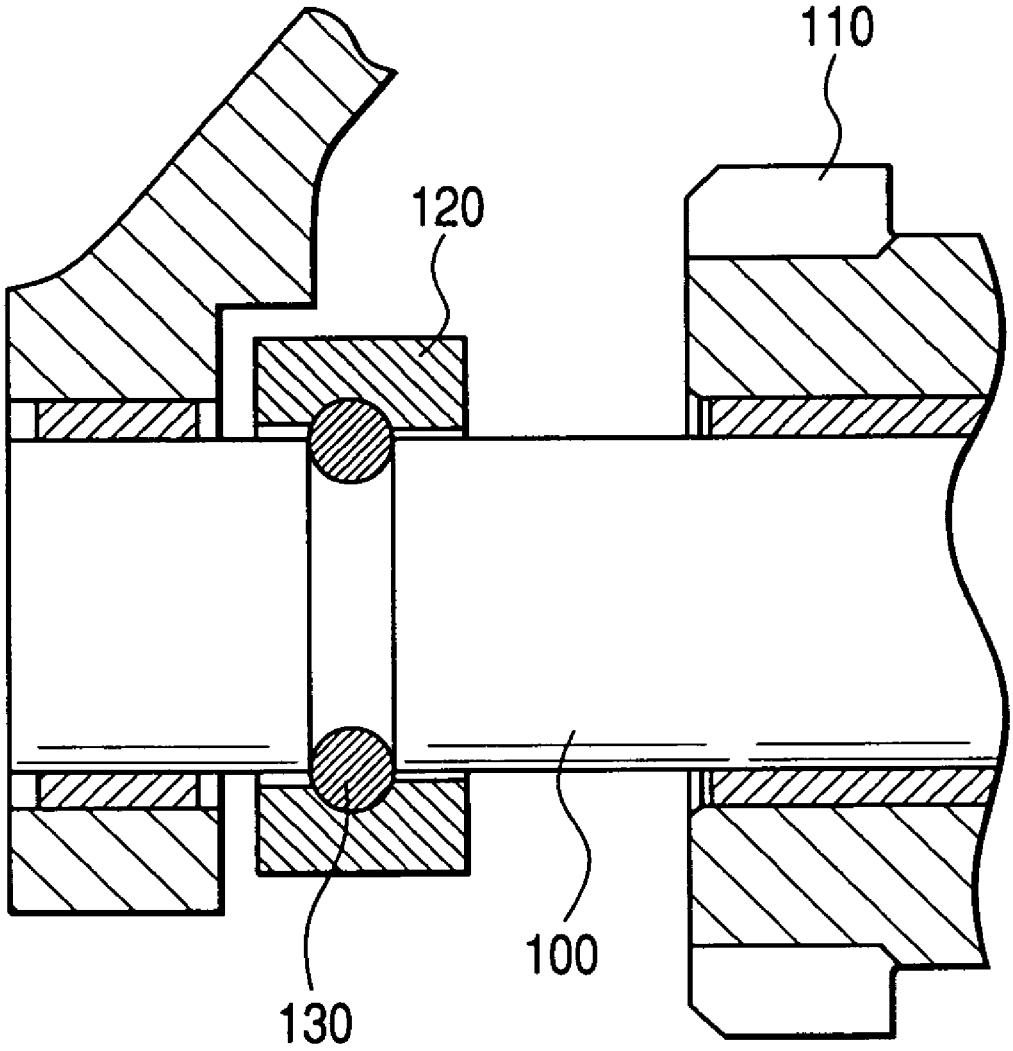
FIG. 14 PRIOR ART
FIG. 14 is a cross-sectional view of a part of a starter having an output shaft carrying thereon a stop collar of the related art structure.
Figure 15A:
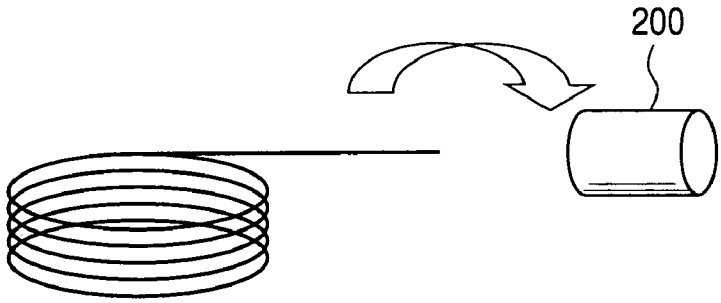
FIG. 15A PRIOR ART
FIGS. 15A to 15D are views showing a basic sequence of carrying out a method of fabricating an annular component part in accordance with the related art practice.
Figure 15B:
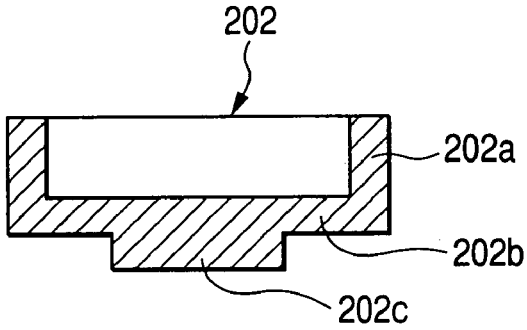
FIG. 15B PRIOR ART
Figure 15C:
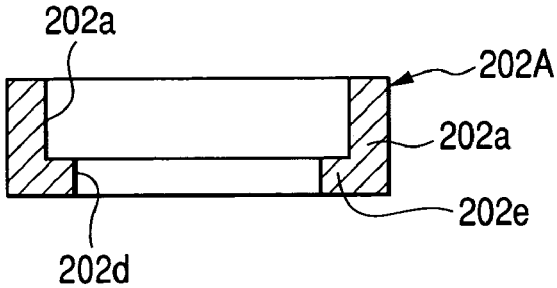
FIG. 15C PRIOR ART
Figure 15D:
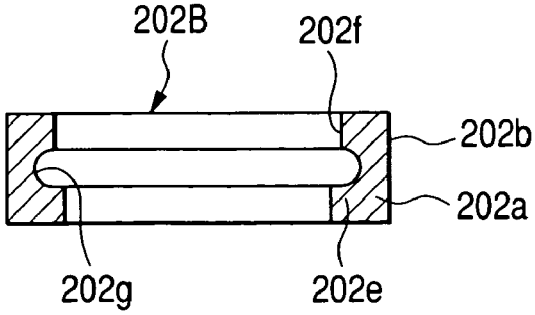
FIG. 15D PRIOR ART

(2) Base Bore Forming Step: The workpiece 5C, formed in the circular shape, is punched to form a base bore 34 at a radially central area of the workpiece 5C (in the same step as the bore punching step of the fabricating method of the first embodiment) using the press-forming machine as shown in FIG. 13B (3) Base Bore Expanding Step: The workpiece 5C is set on a lower die of the press-forming machine in the same manner as shown in FIG. 7 and an inner diametric expanding punch (not shown) is prepared and mounted on the press-forming machine. Then, the inner diametric expanding punch is lowered to cause the expanding of the base bore 34, thereby forming an inner circumferential periphery 36 in an expanded bore and a cylindrical wall 7C, having a tapered outer periphery 38, as shown in FIG. 13C (in the same step as the inner diametric expanding step of the fabricating method of the first embodiment) such that the cylindrical wall 7C is formed on the workpiece 5C on one side thereof.

(4) Outer Diametric Blanking Step: Outer diametric blanking is made on the annular flange portion 8C of the workpiece 5C in a diameter of a final profile using the press-forming machine.

(5) Cutting Step: The inner circumferential periphery 36 of the cylindrical wall 7C is subjected to cutting operation to form an inner diametric concave portion 25C, playing a role as an undercut, on an inner circumferential periphery of the cylindrical wall 7C.

While the specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention, which is to be given the full breadth of the following claims and all equivalents thereof.

What is claimed is:

1. A method of fabricating an annular component part, the method comprising:

preparing a circular piece of metallic raw material;

forming a base bore in a radially center position of the circular piece;

expanding the base bore of the circular piece to form an expanded bore in the circular piece while forming a cylindrical wall on a central area of the circular piece on one side thereof in a thickness direction such that the circular piece has a radially extending annular flange portion integrally contiguous with a root portion of the cylindrical wall;

preprocessing an inner circumferential periphery of the cylindrical wall to form an annular stepped striation on the inner circumferential periphery of the cylindrical wall in an area in close proximity to the radially extending annular flange portion which serves as a deformation initiating point at which the cylindrical wall is initiated to deform radially inward; and squeezing the cylindrical wall on an outer circumferential periphery thereof causing a deformation to occur on the cylindrical wall at the deformation initiating point formed during the preprocessing step to form in the cylindrical wall a tapered profile thereby providing an annular body, wherein the cylindrical wall has an inner diameter gradually decreasing in diameter from the root portion of the cylindrical wall to be less than an open end of the cylindrical wall, and the squeezing step is executed with a tapered punch held in abutting engagement with the outer circumferential periphery of the cylindrical wall of the annual body.

2. The method of fabricating the annular component part according to claim 1, wherein:

the step of the preprocessing is executed concurrently with the expanding the inner circumferential periphery of the cylindrical wall or in a phase between the expanding the inner circumferential periphery of the cylindrical wall and the squeezing the cylindrical wall.

3. The method of fabricating the annular component part according to claim 1, further comprising:

conducting inner diametric chamfering operation upon compressing an inner diametric corner of a distal end of the cylindrical wall to form a chamfer thereon prior to the step of squeezing the cylindrical wall.

4. The method of fabricating the annular component part according to claim 3, wherein:

the inner diametric chamfering operation is executed before executing the step of expanding the inner circumferential periphery of the cylindrical wall.

5. The method of fabricating the annular component part according to claim 1, further comprising:

conducting a preliminary chamfering operation prior to the step of expanding the inner circumferential periphery of the cylindrical wall to form a chamfering annular concave portion on an end face of the annular body in an entire circumference thereof at a position in opposition to the cylindrical wall so as to allow a final configuration to have an outer peripheral corner portion formed with a chamfer; and conducting an outer diametric blanking operation after the step of squeezing the cylindrical wall to blank the annular body at the chamfering annular concave portion thereof in an outer diameter of a final shape.

6. A method of fabricating an annular component part, the method comprising:

a) preparing a plate-like metallic raw material and conducting a first outer diametric blanking operation to form the metallic raw material into a circular component by blanking;

b) conducting a base bore punching operation to form a base bore in the circular component at a radially central area thereof;

c) conducting a base bore expanding operation to expand the base bore of the circular component to provide an annular body including a cylindrical wall on the circular component on one side thereof while forming an annular flange portion radially extending from a root portion of the cylindrical wall;

d) conducting a preliminary chamfering operation to preliminarily form a chamfering annular concave portion on the annular flange portion at an end face thereof in opposition to the cylindrical wall so as to allow the annular body to be formed in a final configuration with an outer peripheral corner portion formed with a chamfer;

e) preprocessing the inner circumferential periphery of the cylindrical wall to form a deformation initiating point where the cylindrical wall is initiated to deform radially inward by forming an annular stepped striation on the inner circumferential periphery of the cylindrical wall in an area in close proximity to the radially extending annular flange portion;

f) conducting an inner diametric chamfering operation to compress an inner diametric corner area of a distal end of the cylindrical wall to form a chamfer thereon;

g) conducting an inner diametric expanding operation upon forcing a punch into the inner circumferential periphery of the cylindrical wall and expanding the same to an inner diameter corresponding to that of the inner diametric concave portion;

h) conducting a squeezing operation on the cylindrical wall at the outer circumferential periphery thereof so as to cause a deformation to occur on the cylindrical wall at the deformation initiating point formed during the preprocessing step thereby, providing the annular body including the cylindrical wall with an inner diameter that gradually decreases from the root portion to an open end of the cylindrical wall, the squeezing operation being executed upon using a tapered punch held in abutting engagement with an outer circumferential periphery of the cylindrical wall of the annular body; and i) conducting a second outer diametric blanking operation to blank the circular component along with the chamfering annular concave portion into a final configuration.

7. The method of fabricating the annular component part according to claim 6, wherein the preprocessing is executed concurrently with the inner diametric expanding operation or in a phase between inner diametric expanding operation and the squeezing operation.

8. A die for use in an inner diametric expanding operation conducted in a method of fabricating an annular component part, in which the method includes: a) preparing a platelike metallic raw material and conducting a first outer diametric blanking operation to form the metallic raw material into a circular component by blanking; b) conducting a base bore punching operation to form a base bore in the circular component at a radially central area thereof; c) conducting a base bore expanding operation to expand the base bore of the circular component to provide an annular body including a cylindrical wall on the circular component on one side thereof while forming an annular flange portion radially extending from a root portion of the cylindrical wall; d) conducting a preliminary chamfering operation to preliminarily form a chamfering annular concave portion on the annular flange portion at an end face thereof in opposition to the cylindrical wall so as to allow the annular body to be formed in a final configuration with an outer peripheral corner portion formed with a chamfer; e) preprocessing the inner circumferential periphery of the cylindrical wall to form a deformation initiating point where the cylindrical wall is initiated to deform radially inward by forming an annular stepped striation on the inner circumferential periphery of the cylindrical wall in an area in close proximity to the radially extending annular flange portion; f) conducting an inner diametric chamfering operation to compress an inner diametric corner area of a distal end of the cylindrical wall to form a chamfer thereon; g) conducting the inner diametric expanding operation upon forcing a punch into the inner circumferential periphery of the cylindrical wall and expanding the same to an inner diameter corresponding to that of the inner diametric concave portion; h) conducting a squeezing operation on the cylindrical wall at the outer circumferential periphery thereof so as to cause a deformation to occur on the cylindrical wall at the deformation initiating point formed during the preprocessing step thereby, providing the annular body including the cylindrical wall with an inner diameter that gradually decreases from the root portion to an open end of the cylindrical wall, the squeezing operation being executed upon using a tapered punch held in abutting engagement with an outer circumferential periphery of the cylindrical wall of the annular body: and i) conducting a second outer diametric blanking operation to blank the circular component along with the champering annular concave portion into a final configuration, the die comprising:

a lower die for holding the annular flange portion of the annular body that is subjected to operations up to the inner diametric chamfering operation; and an upper die movable toward and away from the lower die, wherein the lower die has an annular protrusion fitted to the chamfering annular concave portion of the annular flange portion and operative to hold the annular body when the chamfering annular concave portion is fitted to the annular protrusion of the lower die, the upper die includes an expanding punch for expanding the inner circumferential periphery of the cylindrical wall to the inner diameter corresponding to that of the inner diametric concave portion, and a holder die for holding the outer periphery of the cylindrical wall during movement of the expanding punch to expand the inner circumferential periphery of the cylindrical wall, the holder die being spring biased to be pressurized toward the lower die and movable along an axis of the annular body and having an inner circumferential periphery, engageable with the outer periphery of the cylindrical wall, and a bottom wall operative to hold the annular flange portion of the annular body before the expanding punch begins to expand the cylindrical wall, and the expanding punch has a lower end portion formed with an outer diametric stepped portion to form the annular stepped striation on the inner circumferential periphery of the cylindrical wall for the deformation to be initiated at the annular stepped striation.

9. The die for use in the inner diametric expanding operation conducted in the method according to claim 8, wherein:

the expanding punch has an end portion formed with an outer diametric stepped portion for preliminarily forming the annular stepped portion on the inner circumferential periphery of the cylindrical wall in the striation as the deformation start point when executing the squeezing operation.

10. A die for use in an inner diametric chamfering operation conducted in a method of fabricating an annular component part, in which the method includes: a) preparing a plate-like metallic raw material and conducting a first outer diametric blanking operation to form the metallic raw material into a circular component by blanking; b) conducting a base bore punching operation to form a base bore in the circular component at a radially central area thereof; c) conducting a base bore expanding operation to expand the base bore of the circular component to provide an annular body including a cylindrical wall on the circular component on one side thereof while forming an annular flange portion radially extending from a root portion of the cylindrical wall; d) conducting a preliminary chamfering operation to preliminarily form a chamfering annular concave portion on the annular flange portion at an end face thereof in opposition to the cylindrical wall so as to allow the annular body to be formed in a final configuration with an outer peripheral corner portion formed with a chamfer; e) preprocessing the inner circumferential periphery of the cylindrical wall to form a deformation initiating point where the cylindrical wall is initiated to deform radially inward by forming an annular stepped striation on the inner circumferential periphery of the cylindrical wall in an area in close proximity to the radially extending annular flange portion; f) conducting the inner diametric chamfering operation to compress an inner diametric corner area of a distal end of the cylindrical wall to form a chamfer thereon; g) conducting an inner diametric expanding operation upon forcing a punch into the inner circumferential periphery of the cylindrical wall and expanding the same to an inner diameter corresponding to that of the inner diametric concave portion; h) conducting a squeezing operation on the cylindrical wall at the outer circumferential periphery thereof so as to cause a deformation to occur on the cylindrical wall at the deformation initiating point formed during the preprocessing step thereby, providing the annular body including the cylindrical wall with an inner diameter that gradually decreases from the root portion to an open end of the cylindrical wall, the squeezing operation being executed upon using a tapered punch held in abutting engagement with an outer circumferential periphery of the cylindrical wall of the annular body; and i) conducting a second outer diametric blanking operation to blank the circular component alone with the chamfering annular concave portion into a final configuration, the die comprising:

a lower die for holding the annular flange portion of the annular body that is subjected to operations up to the preliminarily chamfering operation; and an upper die movable toward and away from the lower die, wherein the lower die has an annular protrusion available to be fitted to the chamfering annular concave portion, formed on the annular flange portion of the annular body, and operative to hold the annular body under a condition where the chamfering annular concave portion is fitted to the annular protrusion of the lower die, the upper die includes a chamfering punch for compressing an inner diametric corner area of the distal end of the cylindrical wall to form a chamfer thereon, and a holder die for holding the outer periphery of the cylindrical wall during movement of the chamfering punch, the holder die being spring biased to be pressurized toward the lower die and movable along an axis of the annular body and having an inner circumferential periphery, engageable with the outer periphery of the cylindrical wall, and a bottom wall operative to hold the annular flange portion of the annular body before the chamfering punch begins to form the chamfer on the inner diametric corner area of the cylindrical wall; and the expanding punch has a lower end portion formed with an outer diametric stepped portion to form the annular stepped striation on the inner circumferential periphery of the cylindrical wall for the deformation to be initiated at the annular stepped striation.

11. A die for use in a squeezing operation conducted in a method of fabricating an annular component part, in which the method includes: a) preparing a plate-like metallic raw material and conducting a first outer diametric blanking operation to form the metallic raw material into a circular component by blanking; b) conducting a base bore punching operation to form a base bore in the circular component at a radially central area thereof; c) conducting a base bore expanding operation to expand the base bore of the circular component to provide an annular body including a cylindrical wall on the circular component on one side thereof while forming an annular flange portion radially extending from a root portion of the cylindrical wall; d) conducting a preliminary chamfering operation to preliminarily form a chamfering annular concave portion on the annular flange portion at an end face thereof in opposition to the cylindrical wall so as to allow the annular body to be formed in a final configuration with an outer peripheral corner portion formed with a chamfer; e) preprocessing the inner circumferential periphery of the cylindrical wall to form a deformation initiating point where the cylindrical wall is initiated to deform radially inward by forming an annular stepped striation on the inner circumferential periphery of the cylindrical wall in an area in close proximity to the radially extending annular flange portion; f) conducting an inner diametric chamfering operation to compress an inner diametric corner area of a distal end of the cylindrical wall to form a chamfer thereon; g) conducting an inner diametric expanding operation upon forcing a punch into the inner circumferential periphery of the cylindrical wall and expanding the same to an inner diameter corresponding to that of the inner diametric concave portion; h) conducting the squeezing operation on the cylindrical wall at the outer circumferential periphery thereof so as to cause a deformation to occur on the cylindrical wall at the deformation initiating point formed during the preprocessing step thereby, providing the annular body including the cylindrical wall with an inner diameter that gradually decreases from the root portion to an open end of the cylindrical wall, the squeezing operation being executed upon using a tapered punch held in abutting engagement with an outer circumferential periphery of the cylindrical wall of the annular body; and i) conducting a second outer diametric blanking operation to blank the circu lar component along with the chamfering annular concave portion into a final configuration, the die comprising:

a lower die for holding the annular flange portion of the annular body that is subjected to operations up to the inner diametric expanding operation, wherein the lower die has an annular protrusion available to be fitted to the chamfering annular concave portion, formed on the annular flange portion of the annular body, and operative to hold the annular body when the chamfering annular concave portion is fitted to the annular protrusion of the lower die, and the expanding punch has a lower end portion formed with an outer diameter stepped portion to form the annular stepped striation on the inner circumferential periphery of the cylindrical wall for the deformation to be initiated at the annular stepped striation.

* * * * *